US010689181B2

(12) United States Patent
Hara et al.

(10) Patent No.: US 10,689,181 B2
(45) Date of Patent: Jun. 23, 2020

(54) MIXING CONTAINER, MIXING CONTAINER KIT, METHOD OF USING MIXING CONTAINER OR MIXING CONTAINER KIT, AND ASSISTIVE DEVICE OF MIXING CONTAINER

(71) Applicant: KABUSHIKI KAISHA SHOFU, Kyoto (JP)

(72) Inventors: Daisuke Hara, Kyoto (JP); Naoya Kitada, Kyoto (JP); Kenzou Yamamoto, Kyoto (JP); Masahiro Kakimoto, Hyogo (JP); Yoshiyuki Mizoguchi, Oita (JP); Yuuta Yamada, Hyogo (JP); Hirokazu Muranushi, Hyogo (JP)

(73) Assignee: KABUSHIKI KAISHA SHOFU, Kyoto (JP)

( * ) Notice: Subject to any disclaimer, the term of this patent is extended or adjusted under 35 U.S.C. 154(b) by 109 days.

(21) Appl. No.: 15/918,338

(22) Filed: Mar. 12, 2018

(65) Prior Publication Data

US 2018/0265275 A1 Sep. 20, 2018

(30) Foreign Application Priority Data

Mar. 14, 2017 (JP) ..... 2017-048869
Feb. 27, 2018 (JP) ..... 2018-033370

(51) Int. Cl.
*B65D 81/32* (2006.01)

(52) U.S. Cl.
CPC ..... *B65D 81/3255* (2013.01); *B65D 81/32* (2013.01); *B65D 81/3222* (2013.01);
(Continued)

(58) Field of Classification Search
CPC ..... B65D 81/3255; B65D 81/32; B65D 81/3222; B65D 2543/0037; B65D 81/3266; B65D 81/3294
(Continued)

(56) References Cited

U.S. PATENT DOCUMENTS 3,145,838 A * 8/1964 Van Deusen ..... B65D 77/22 206/221
3,220,544 A * 11/1965 Lovell ..... B29C 51/08 206/218
(Continued)

FOREIGN PATENT DOCUMENTS

BE 67 65 2 2 7/1966
DE 10 2006 040 083 3/2008
(Continued)

OTHER PUBLICATIONS

Extended European Search Report dated Nov. 29, 2018 in corresponding European Patent Application No. 18161013.0.
(Continued)

*Primary Examiner* — Rafael A Ortiz
(74) *Attorney, Agent, or Firm* — Wenderoth, Lind & Ponack, L.L.P.

(57) ABSTRACT

A mixing container for mixing multiple materials comprises a container body in which multiple storage chambers are formed in a storage part by a partition wall that is a raised portion of a wall surface forming the storage part, and a lid member attached to the container body such that the multiple storage chambers are separately sealed; the partition wall is configured to be deformable into a concave part recessed in a movement direction of the partition wall through movement in a direction from the lid member toward the container body with a circumferential edge of the storage part sealed to the lid member; and when the partition
(Continued)

wall is deformed into the concave part, the multiple storage chambers are deformed into one storage chamber.

16 Claims, 13 Drawing Sheets

(52) U.S. Cl.
CPC ..... *B65D 81/3266* (2013.01); *B65D 81/3294* (2013.01); *B65D 2543/0037* (2013.01)

(58) Field of Classification Search
USPC ..... 206/219, 499, 501, 502, 514, 520, 564, 206/368, 369, 63.5; 220/501, 506
See application file for complete search history.

(56) References Cited

U.S. PATENT DOCUMENTS

| | | | | |
|---|---|---|---|---|
| 3,261,458 A | | 7/1966 | Nibecker | |
| 4,470,505 A | * | 9/1984 | Korwin | A61C 5/66 206/219 |
| 8,887,942 B2 | * | 11/2014 | Miksovsky | B65D 1/40 206/218 |

FOREIGN PATENT DOCUMENTS

| | | | | |
|---|---|---|---|---|
| GB | 2530800 | | 4/2016 | |
| GB | 2530800 A | * | 4/2016 | B65D 81/32 |
| JP | 5-22374 | | 3/1993 | |
| JP | 2001-136943 | | 5/2001 | |
| JP | 2002-104417 | | 4/2002 | |
| WO | WO-0196192 A1 | * | 12/2001 | B65D 21/086 |
| WO | 2008/025501 | | 3/2008 | |

OTHER PUBLICATIONS

Partial European Search Report dated Jul. 11, 2018 in European Application No. 18161013.0.
Office Action dated Jan. 2, 2020 in corresponding European Patent Application No. 18161013.0.

* cited by examiner

MIXING CONTAINER, MIXING CONTAINER KIT, METHOD OF USING MIXING CONTAINER OR MIXING CONTAINER KIT, AND ASSISTIVE DEVICE OF MIXING CONTAINER

TECHNICAL FIELD

The present invention relates to a mixing container for mixing multiple materials, a mixing container kit including the mixing container, a method of using the mixing container or the mixing container kit, and an assistive device of the mixing container.

BACKGROUND ART

A mixing container for mixing multiple materials is disclosed in, for example, Japanese Patent Publication No. 2002-104417 (JP 2002-104417) and Japanese Patent Publication No. 2001-136943 (JP 2001-136943) as containers that can be switched from a state in which two storage chambers are formed by a partition part to a state in which the two storage chambers are deformed into one storage chamber by deforming the partition part. According to these containers, the materials are stored in the respective storage chambers while the two storage chambers are formed, and a lid is subsequently put on to separately store the two materials. The lid is peeled before use, and the partition part is then deformed to put the storage chambers into one so that the two materials can be mixed.

A container disclosed in Japanese Unexamined Utility Model Application Publication No. 5-22374 (JP 5-22374) has a lid put on the container having two storage chambers with materials separately stored in the respective storage chambers such that when a pressing force is applied to one of the storage chambers, only a seal between the one storage chamber and the other storage chamber is peeled to allow the material in the one storage chamber to flow into the other storage chamber, so that the materials can be mixed while being covered with the lid.

SUMMARY OF THE INVENTION

Problem to be Solved by the Invention

However, in the containers described in JP 2002-104417 and JP 2001-136943, the partition part can be deformed only after the lid is peeled, and an impact is somewhat applied to the container for deformation of the partition part. Therefore, the material may spill outside during deformation of the partition part. Moreover, the operation must be performed with care to prevent the material from spilling, which also causes a problem of difficulty in operation.

In the case of the container of JP 5-22374, although the material can be prevented from spilling outside at the time of mixing, a seal must be formed to such an extent that the seal is peeled by a pressing force applied to the storage chamber, so that a seal may be peeled due to some kind of impact in a distribution process etc. Moreover, when the material in one of the storage chambers is allowed to flow into the other storage chamber, the material may remain in one of the storage chambers, and the container has restrictions such as necessity to use a material suitable for flowing out to the other storage chamber, which requires an improvement.

Therefore, it is desired to implement a mixing container, a mixing container kit, a method of using a mixing container or a mixing container kit, and an assistive device of a mixing container capable of making materials smoothly and safely mixable.

Means for Solving Problem

A mixing container according to the present invention is a mixing container for mixing multiple materials, comprising:

a container body including a storage part storing the materials, the storage part having at least one partition wall formed such that a portion of an inner wall surface forming the storage part is raised toward a storage space, the partition wall forming multiple storage chambers capable of separately storing the materials in the storage part; and a lid member attached to the container body to seal a circumferential edge of the storage part and an upper edge of the partition wall partitioning the multiple storage chambers from each other such that the multiple storage chambers are separately sealed, wherein the partition wall is configured to be deformable into a concave part recessed in a movement direction of the partition wall through movement in a direction from the lid member toward the container body with the circumferential edge of the storage part sealed to the lid member, and wherein when the partition wall is deformed into the concave part, the multiple storage chambers formed by the partition wall are deformed into one storage chamber.

According to this configuration, the partition wall forming the multiple storage chambers can be moved in the direction from the lid member toward the container body and thereby deformed into the concave part. As a result, the multiple storage chambers can be deformed into one storage chamber to mix the materials stored in the storage chambers in the one storage chamber. Consequently, the material can effectively be restrained from remaining in one of the storage chambers. In this configuration, the partition wall can be deformed into the concave part while maintaining a state in which the circumferential edge of the storage part is sealed to the lid member. Therefore, the materials can be made smoothly and safely mixable while reliably preventing the materials from spilling outside.

Preferred aspects of the mixing container according to the present invention will hereinafter be described. However, the scope of the present invention is not limited by the exemplary preferred aspects described below.

In one aspect, preferably, the upper edge of the partition wall and the circumferential edge of the storage part are not coupled, and at least one of the storage chambers is formed in a space inside the upper edge of the partition wall while at least one of the storage chambers is formed in a space between the upper edge of the partition wall and the circumferential edge of the storage part.

According to this configuration, the respective storage chambers are suitably formed on the inner side and the outer side of the upper edge of the partition wall.

In one aspect, preferably, the partition wall is a dome-shaped raised portion of the wall surface forming the storage part; the partition wall has at least one concave groove part formed as one of the multiple storage chambers such that a portion of the partition wall is recessed in a concave shape; and the lid member seals a circumferential edge of the concave groove part as the partition wall upper edge.

According to this configuration, since the partition wall has a dome shape easily moved in the direction from the lid member toward the container body, the partition wall can smoothly be deformed into the concave part while forming the multiple storage chambers from the concave groove part by taking advantage of the dome shape.

In one aspect, preferably, the partition wall and the concave groove part are each concentrically formed in a central portion of the storage part.

According to this configuration, after the partition wall is deformed into the concave part, the concave groove part is located in the center and the deepest portion of the one storage chamber. Therefore, after deformation into the concave part, the materials gather in the concave groove part, so that the materials can efficiently be mixed without waste.

In one aspect, preferably, the capacity of the storage chamber formed in the space between the upper edge of the partition wall and the circumferential edge of the storage part is formed larger than the capacity of the storage chamber formed in the space inside the upper edge of the partition wall.

Such a balance of the capacities of the storage chambers facilitates suppression of a change in capacity when the partition wall is deformed into the concave part, and a negative pressure generated after the deformation can effectively be suppressed.

In one aspect, preferably, in the partition wall, a wall thickness of an upper edge portion of the partition wall is formed thicker than a wall thickness of a wall surface portion outside the upper edge portion.

By achieving such a balance of wall thickness, the state of the partition wall deformed into the concave part is easily retained.

In one aspect, preferably, a wall thickness of a circumferential edge portion of the storage part is formed thicker than a wall thickness of a wall surface portion on the outside of the partition wall.

This configuration can enhance the strength of the wall thickness of the circumferential edge portion of the storage part, so that an outer circumferential portion of the storage part can be restrained from deforming due to the deformation of the partition wall.

In one aspect, preferably, the lid member is formed of a stretchable sheet material, and the lid member is configured such that when pressed in a direction toward the container body, the lid member is able to press the partition wall in a direction from the lid member toward the container body as the lid member is stretched and that as the lid member is pressed, the partition wall moves in the direction from the lid member toward the container body.

According to this configuration, since the lid member is a stretchable sheet material, the partition wall can be pressed together with the lid member to deform the partition wall into the concave part with the circumferential edge of the storage part sealed to the lid member.

In one aspect, preferably, the partition wall upper edge is sealed to the lid member by a force allowing the lid member to peel from the partition wall upper edge as the partition wall is deformed into the concave part.

By setting the sealing force of the lid member as in this configuration, the lid member is peeled from the partition wall upper edge as the partition wall is deformed into the concave part, so that the one storage chamber is certainly formed while the circumferential edge of the storage part is sealed to the lid member.

In one aspect, preferably, the lid member is stretchable due to at least plastic deformation.

If the lid member undergoes only elastic deformation, the lid member tends to return to an original position even when the lid member is pressed, so that even if the partition wall is deformed into the concave part, the concave part may return to the partition wall again as the lid member returns to the original position. In contrast, in this configuration, since the lid member is stretched at least due to plastic deformation in this embodiment, the lid member can be restrained or prevented from returning to the original position, and the concave part is effectively restrained from returning to the partition wall again.

In one aspect, preferably, a maximum stretch amount due to plastic deformation of the lid member attached to the container body is an amount allowing a position of a portion sealing the partition wall upper edge after the plastic deformation to be located above a position of a portion corresponding to the partition wall upper edge after deformation of the partition wall into the concave part.

According to this configuration, even if the lid member is plastically deformed, the position of the lid member is located above the position of the portion corresponding to the partition wall upper edge after deformation of the partition wall into the concave part (i.e., the portion to which the lid member is sealed), the portion corresponding to the partition wall upper edge can effectively be restrained from being sealed to the lid member even after the deformation of the partition wall into the concave part.

In one aspect, preferably, the mixing container comprises a handle part having a coupling part coupled to the partition wall and an operating part operated by a user, and as the operating part relatively moves in a direction from the lid member toward the container body with respect to the container body, the partition wall moves together with the coupling part in the direction from the lid member toward the container body.

According to this configuration, since the operation of the operating part directly acts on the partition wall via the coupling part so that only the partition wall can be moved independently of the container body in the direction from the lid member to the container body, the partition wall can be deformed into the concave part with the circumferential edge of the storage part sealed to the lid member.

In one aspect, preferably, the operating part is made up of a pair of members extending from the coupling part to sides opposite to each other.

According to this configuration, the mixing container can stably be placed on a floor surface etc. with a pair of the operating parts extending from the coupling part to the sides opposite to each other, and an acting force can be applied from both sides of the container body, so that the operation can stably be performed.

In one aspect, preferably, the coupling part includes a concealed portion that is not exposed outside when the partition wall is not deformed into the concave part and that is exposed outside when the partition wall is deformed into the concave part, and the concealed portion has an appearance distinguishable from the other portion of the coupling part.

When the partition wall is deformed into the concave part with the circumferential edge of the storage part sealed to the lid member, the state of the inside cannot visually be observed, so that an insufficient movement amount of the partition wall may lead to incomplete deformation into the concave part; however, according to this configuration, it can be confirmed that the partition wall is deformed into the concave part when the concealed portion is exposed outside, so that the case of the incomplete deformation of the partition wall can effectively be suppressed.

In one aspect, preferably, the handle part includes a receiving part receiving at least a portion of the container body coupled to the coupling part, and the receiving part is configured such that a circumferential edge of the receiving part and the container body are flush with each other when receiving the container body.

According to this configuration, when the container body is received by the receiving part, the container body can be supported by the receiving parts to suppress the relative movement of the container body such as tilting of the container body relative to the handle part, and the seal of the upper edge of the partition wall can be restrained from being carelessly peeled.

In one aspect, preferably, the lid member includes a tab, and the tab is disposed along the handle part.

In this configuration, the tab is along the acting part and therefore does not become an obstacle at the normal time, and when the partition wall is deformed into the concave part, the tab is separated from the acting part, so that the tab is easily grasped. As described above, in this configuration, the tab can be placed in an easy-to-use state only when necessary.

A mixing container kit according to the present invention comprises the mixing container according to the present invention; and a mounting member having a hollow receiving part receiving the storage part of the mixing container and a mounting part on which the circumferential edge of the mixing container is mounted.

when the mixing container is used alone, an operation of pressing the partition wall together with the lid member must be performed while supporting the circumferential edge of the mixing container, and the operation must basically be performed with both hands. On the other hand, according to this configuration, the mounting part eliminates the need for the operation of supporting the circumferential edge of the container body, and it is sufficient to press the partition wall together with the lid member toward the hollow receiving part. Therefore, the operation is sufficiently performed with one hand, which makes the operation easier.

Preferred aspects of the mixing container kit according to the present invention will hereinafter be described. However, the scope of the present invention is not limited by the exemplary preferred aspects described below.

In one aspect, preferably, the mixing container kit comprises a retaining mechanism retaining the concave part at the position when the partition wall is deformed into the concave part.

According to this configuration, the state of the partition wall deformed into the concave part can be maintained.

In one aspect, preferably, for the retaining mechanism, an engaged part is formed outside a storage space of a portion serving as the concave part when the partition wall is deformed into the concave part in the storage part, while an engaging part is formed under the receiving part in the mounting member and is engageable with the engaged part when the partition wall is deformed into the concave part.

According to this configuration, the state of the partition wall deformed into the concave part can certainly be maintained by the engagement between the engaged part and the engaging part. Whether the concave part is retained can be determined from a sound generated at the time of the engagement.

A method of using the mixing container according to the present invention or the mixing container kit according to the present invention, comprising deforming the partition wall into the concave part recessed in the movement direction of the partition wall by moving the partition wall of the container body of the mixing container in the direction from the lid member toward the container body with the circumferential edge of the storage part sealed to the lid member.

According to this configuration, since the partition wall is deformed into the concave part with the circumferential edge of the storage part sealed to the lid member, the materials can be made smoothly and safely mixable while reliably preventing the materials from spilling outside.

An assistive device according to the present invention is an assistive device of the mixing container comprising a base;

a hook part disposed on the base and engaged with one end of the handle part of the mixing container; and a convex part disposed on the base and supporting a portion of the container body of the mixing container at a position separated from the hook part in the thickness direction of the base, wherein the convex part is provided with a groove allowing the movement of the partition wall of the container body, wherein the convex part is capable of retaining the other end of the handle part away from the base by supporting the portion of the container body with the one end of the handle part engaged with the hook part, and wherein by moving the other end of the handle part in the direction toward the base with the portion of the container body supported by the convex part, the partition wall is relatively moved in the groove in the direction from the lid member toward the container body with respect to the portion of the container body.

According to this configuration, while the portion of the container body of the mixing container is supported by the convex part, the partition wall can relatively be moved in the direction from the lid member toward the container body with respect to the portion of the container body supported by the convex part. As a result, the partition wall can easily be moved.

MODES FOR CARRYING OUT THE INVENTION

First Embodiment

A first embodiment of a mixing container, a mixing container kit, and a method of using a mixing container or a mixing container kit according to the present invention will be described with reference to FIGS. 1 to 9.

Figure 1:
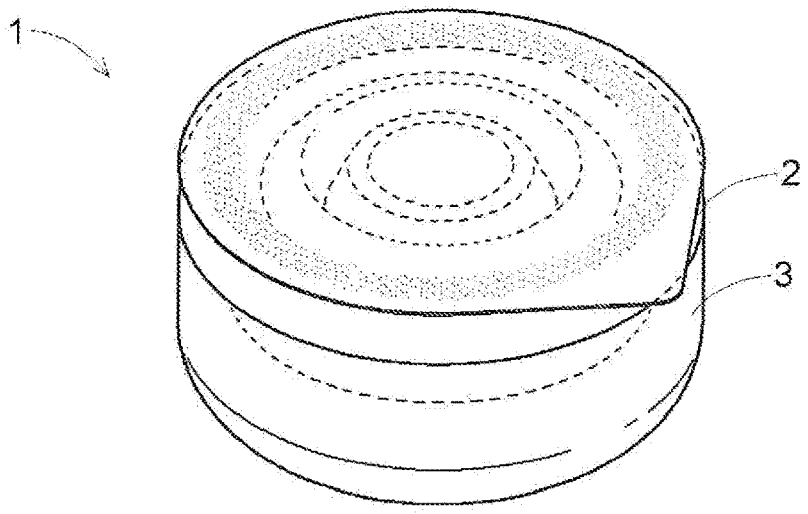
FIG. 1 is a perspective view of a mixing container kit according to a first embodiment.
Figure 2:
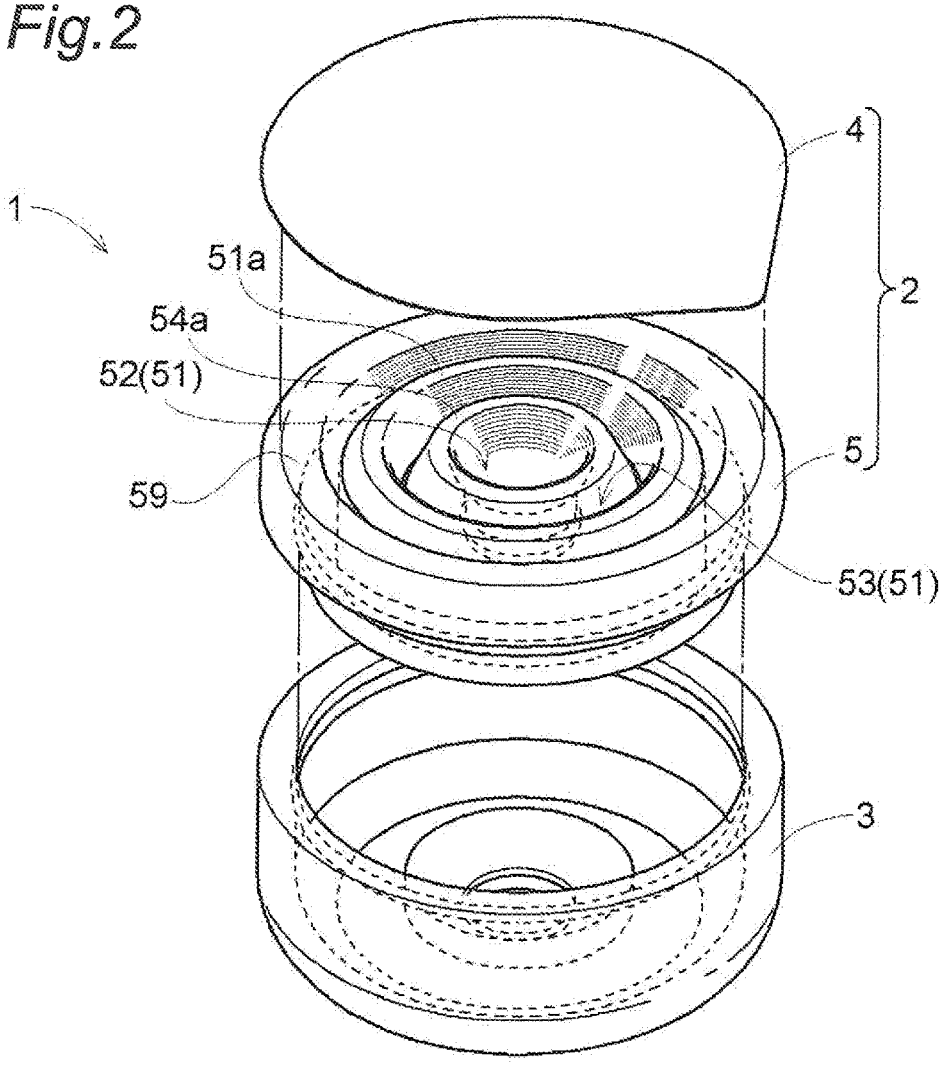
FIG. 2 is an exploded view of the mixing container kit according to the first embodiment.

FIGS. 1 and 2 show a mixing container kit 1 according to a first embodiment. The mixing container kit 1 includes a mixing container 2 for mixing multiple materials and a mounting member 3 for mounting the mixing container 2. The mixing container 2 includes a lid member 4 and a container body 5 having a storage part 51 storing the materials. Specifically, multiple (in this embodiment, two) storage chambers 52, 53 capable of separately storing the materials are formed in the storage part 51 in the container body 5, and the lid member 4 is attached to the container body 5 to seal a circumferential edge 51*a* of the storage part 51 and a portion partitioning the multiple storage chambers 52, 53 from each other (an upper edge 54*a* of a partition wall 54 described later) such that the multiple storage chambers 52, 53 are separately sealed. Because of such a structure of the mixing container 2, respective materials can be stored in the storage chambers 52, 53 and covered with the lid member 4 to store the multiple materials separately in the mixing container 2.

Figure 3A:
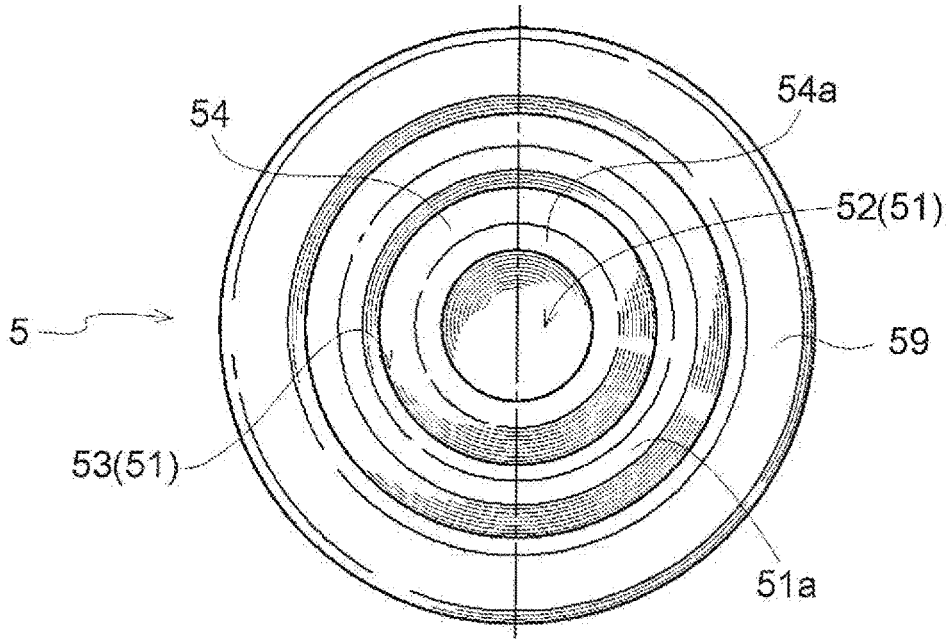
FIG. 3A is a plane view of a mixing container according to the first embodiment.
Figure 3B:
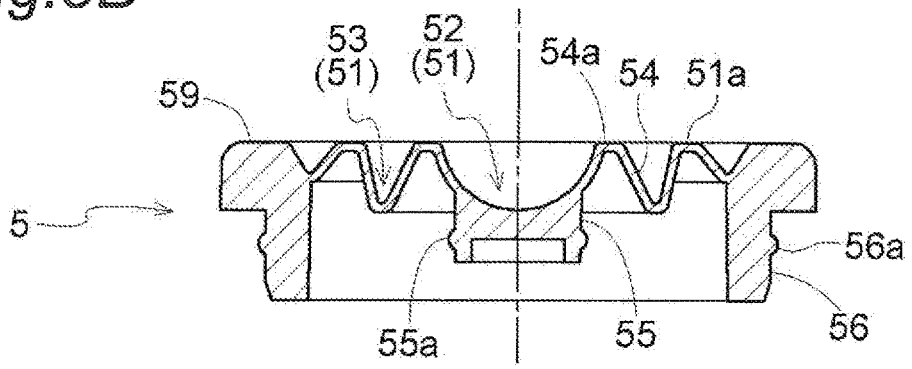
FIG. 3B is a front cross-sectional view of the mixing container according to the first embodiment.
Figure 3C:
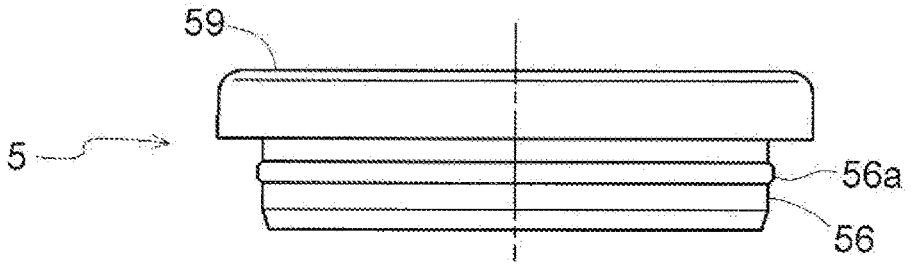
FIG. 3C is a front view of the mixing container according to the first embodiment.

Describing the container body 5 in more detail, as shown in FIGS. 3A, 3B, and 3C, the storage part 51 has the one partition wall 54 formed such that a portion of a wall surface forming the storage part 51 is raised toward a storage space, and the multiple storage chambers 52, 53 capable of separately storing the materials are formed by the partition wall 54 in the storage part 51. In other words, the storage chambers 52, 53 are partitioned from each other by the partition wall 54. Specifically, in this embodiment, the partition wall upper edge 54*a* and the storage part circumferential edge 51*a* are not coupled so that at least one storage chamber is formed in a space inside the partition wall upper edge 54*a* (on the center side of the storage part 51) while at least one storage chamber is formed in a space between the partition wall upper edge 54*a* and the storage part circumferential edge 51*a*. More specifically, the partition wall 54 is a portion of the wall surface forming the storage part 51 raised in a dome shape toward the lid member 4. The partition wall 54 has one concave groove part formed as the storage chamber 52 such that a portion of the partition wall 54 is recessed in a concave shape. Therefore, the lid member 4 seals the circumferential edge of the concave groove part serving as the partition wall upper edge 54*a*. The partition wall 54 and the storage chamber 52 (concave groove part) are each concentrically formed in a central portion of the storage part 51. As a result, the storage chamber 53 is an annular storage chamber.

In the example described in this embodiment, the partition wall 54 is a portion of the wall surface forming the storage part 51 raised in a dome shape toward the lid member 4; however, the present invention is not limited thereto. The partition wall 54 may have a shape in which a portion of the wall surface forming the storage part 51 is raised in a convex shape toward the lid member 4. This makes it possible to flatten the partition wall upper edge 54*a* at which the partition wall 54 and the lid member 4 contact each other. Consequently, the contact area between the lid member 4 and the partition wall upper edge 54*a* can be increased to improve a sealing performance.

An engaged part 55 is formed outside a storage space of the storage chamber 52 (an example of a portion serving as a concave part 57 described later when the partition wall 54 is deformed into the concave part 57) in the storage part 51. More specifically, the engaged part 55 is formed into a columnar shape extending vertically downward and has an outer circumferential surface provided with an engaging convex part 55*a* for engaging with an engaging part 33 of a mounting member 3 described later. The engaged part 55 is hollowed out in a circle at a leading end so that the leading end is easily deformed, and the leading end can easily be penetrated into the engaging part 33. Additionally, the container body 5 is provided with an annular insertion part 56 for insertion into the mounting member 3 in a lower portion of a circumferential edge 59 of the container body 5. An engaging convex part 56*a* is disposed on an outer circumferential surface of the insertion part 56. The engaging convex part 56*a* is engaged with an engaging concave part 34 of the mounting member 3, so that the mixing container 2 and the mounting member 3 are firmly coupled.

Figure 4:
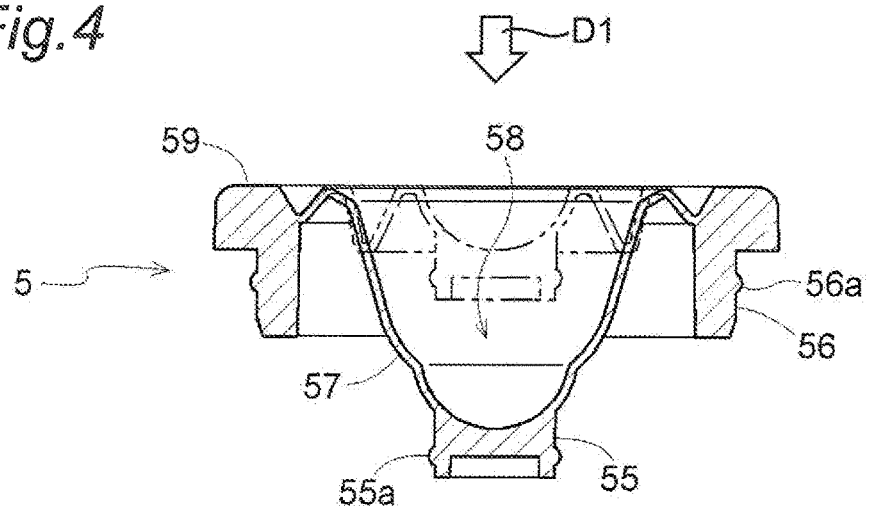
FIG. 4 is a view of a state in which a partition wall of the mixing container according to the first embodiment is deformed into a concave part.

In the container body 5 according to this embodiment, the partition wall 54 is deformable. Specifically, as shown in FIG. 4, the partition wall 54 is configured to be relatively movable in a direction opposite to a raised direction (in a direction toward the outside of the storage space) with respect to a remaining portion of an inner wall surface and to be deformable into a concave part 57 recessed toward the opposite direction side from the remaining portion of the inner wall surface when relatively moved in the opposite direction. The remaining portion of the inner wall surface is a portion including the circumferential edge 51*a* of the storage part 51.

Therefore, when moved in a direction D1 from the lid member 4 toward the container body 5 with the circumferential edge 51*a* of the storage part 51 sealed to the lid member 4, the partition wall 54 is deformable into the concave part 57 recessed in the movement direction of the partition wall 54 (the direction D1 from the lid member 4 toward the container body 5).

Particularly, in this embodiment, the partition wall 54 is deformable into the concave part 57 when pressed in the direction opposite to the raised direction, i.e., in the direction D1 from the lid member 4 toward the container body 5. When the partition wall 54 is deformed into the concave part 57, the multiple storage chambers 52, 53 formed by the partition wall 54 are deformed into one integrated storage chamber 58. As a result, the materials stored in the storage chambers 52, 53 can be mixed in the integrated storage chamber 58. By applying a force to the concave part 57 of this embodiment in a direction toward the inside of the storage space (direction from the container body 5 toward the lid member 4), the concave part 57 can be deformed into the partition wall 54 again.

In this case, since the partition wall 54 has a domed shape easily pressed in the direction (direction D1) opposite to the raised direction, the partition wall 54 can smoothly deformed into the concave part 57 while forming the storage chamber 52 from the concave groove part by taking advantage of the domed shape. Since the partition wall 54 and the concave groove part (the storage chamber 52) are each concentrically formed in the central portion of the storage part 51, the concave groove part is located in the center and the deepest portion of the integrated storage chamber 58 after the partition wall 54 is deformed into the concave part 57. Therefore, after deformation into the concave part 57, the materials gather in the concave groove part, so that the materials can efficiently be mixed without waste.

Figure 5A:
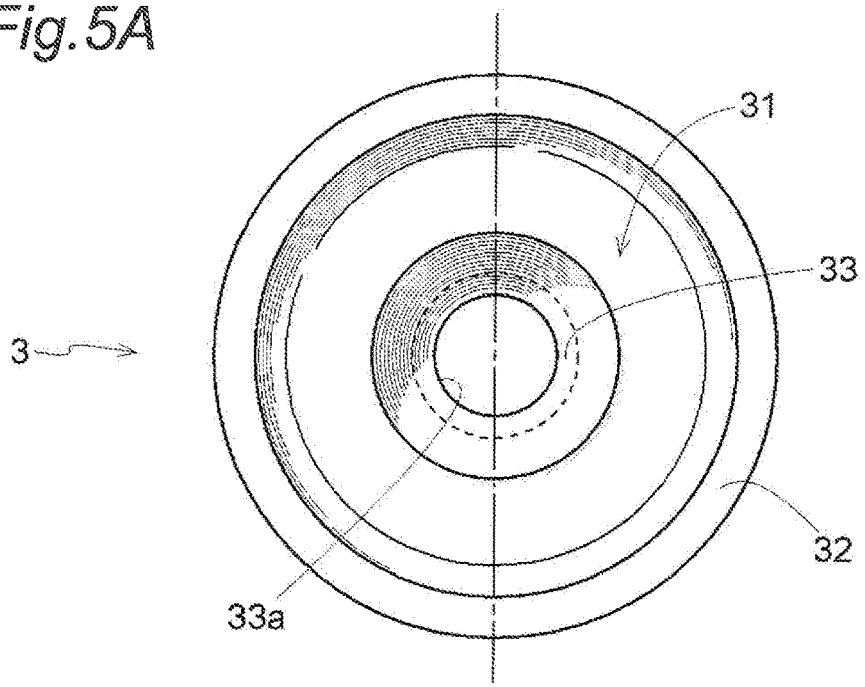
FIG. 5A is a plane view of a mounting member according to the first embodiment.
Figure 5B:
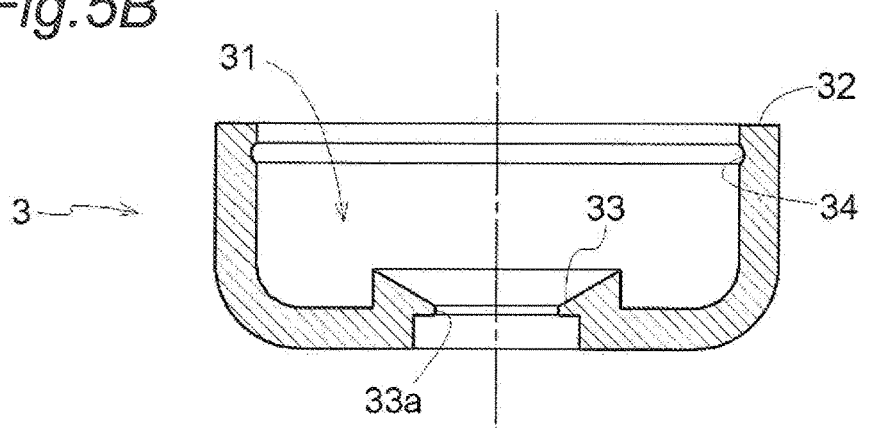
FIG. 5B is a front cross-sectional view of the mounting member according to the first embodiment.
Figure 5C:
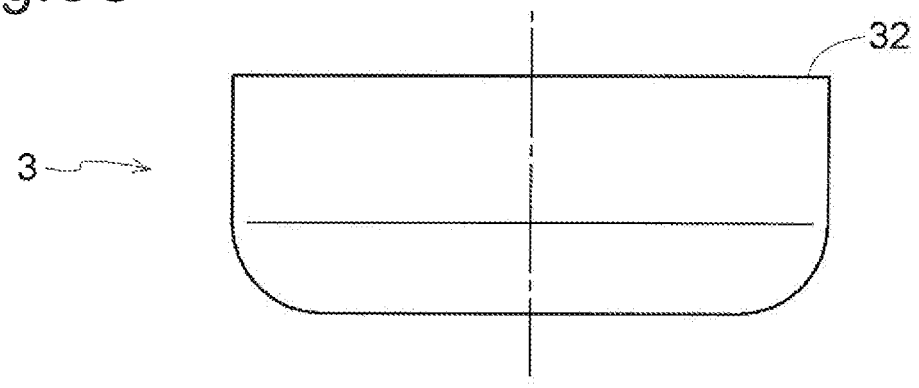
FIG. 5C is a front view of the mounting member according to the first embodiment.

Describing the mounting member 3, as shown in FIGS. 5A, 5B, and 5C, the mounting member 3 includes a hollow receiving part 31 receiving the storage part 51 of the mixing container 2 and a mounting part 32 on which the circumferential edge 59 of the container body 5 is mounted. The receiving part 31 has a capacity capable of receiving at least the storage part 51 while the partition wall 54 is deformed into the concave part 57 so that the integrated storage chamber 58 is formed. As a result, the storage part 51 can be deformed in the receiving part 31. Although the mounting part 32 may have any shape capable of supporting the circumferential edge 59 of the container body 5, the mounting part in this embodiment has a shape corresponding to the circumferential edge 59 of the container body 5 and has an annular shape.

The engaging part 33 is formed under the receiving part 31 in the mounting member 3 and is engageable with the engaged part 55 when the partition wall 54 is deformed into the concave part 57. Specifically, the engaging part 33 has an insertion hole 33*a* formed into a shape corresponding to the engaged part 55. By inserting the engaged part 55 into the insertion hole 33*a* and engaging the engaging part 33 (more specifically, a circumferential edge of the insertion hole 33*a*) and the engaging convex part 55*a*, the concave part 57 is retained at a position after the deformation. In other words, when the engaged part 55 of the container body 5 and the engaging part 33 of the mounting member 3 function as a retaining mechanism retaining the concave part 57 at the position when the partition wall 54 is deformed into the concave part 57. In this way, the state of the partition wall 54 deformed into the concave part 57 can be maintained by the retaining mechanism made up of the engaged part 55 and the engaging part 33. Particularly, the state of the partition wall 54 deformed into the concave part 57 can certainly be maintained by the engagement between the engaged part 55 and the engaging part 33. Whether the concave part 57 is retained by the retaining mechanism can be determined from a sound generated at the time of the engagement.

Additionally, on an inner circumferential surface of the receiving part 31 in the mounting member 3, an engaging concave part 34 is disposed for engagement with the engaging convex part 56*a* of the insertion part 56. As the insertion part 56 of the mixing container 2 is inserted into the receiving part 51 of the mounting member 3, the engaging convex part 56*a* of the insertion part 56 and the engaging concave part 34 are engaged so that the mixing container 2 and the mounting member 3 are firmly coupled.

Figure 7:
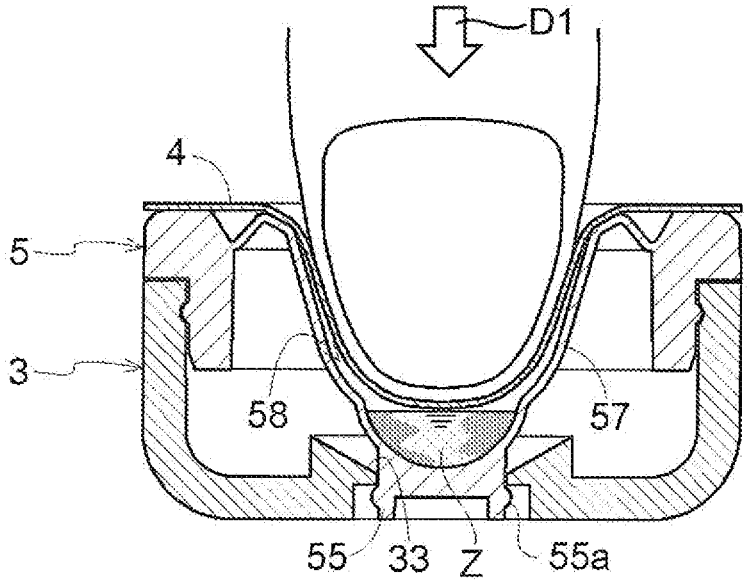
FIG. 7 is a view of a state in which the partition wall is pressed together with a lid member in the mixing container kit shown in FIG. 6.
Figure 8:
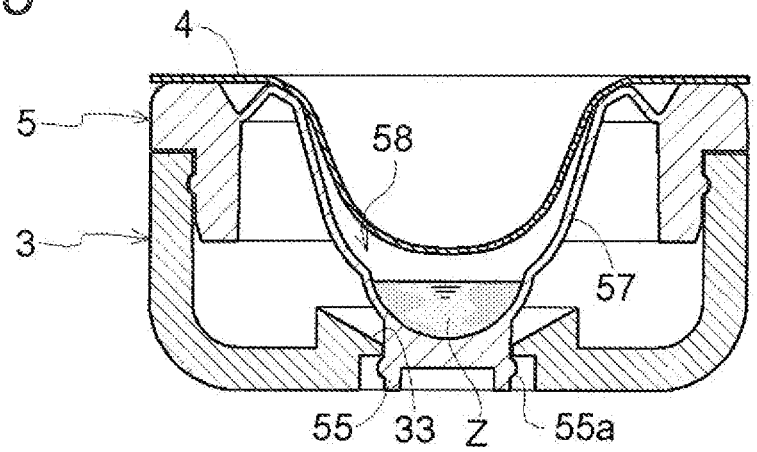
FIG. 8 is a view of a state after pressing the partition wall together with the lid member in the mixing container kit shown in FIG. 7.

The lid member 4 in this embodiment will be described. In this embodiment, as shown in FIGS. 7 and 8, the lid member 4 is formed of a stretchable sheet material. The lid member 4 functions as an acting part to which an action from a user is applied, and can allow the partition wall 54 to relatively move in the direction opposite to the raised direction with respect to the remaining portion of the inner wall surface in accordance with the action from the user while maintaining a state of the circumferential edge 51*a* of the storage part 51 sealed to the lid member 4. Specifically, when the lid member 4 is pressed in the direction opposite to the raised direction of the partition wall 54 (in the direction toward the inside of the container body 5 as viewed from the lid member 4), the partition wall 54 can also be pressed in the opposite direction as the lid member 4 is stretched. As the lid member 4 is pressed, the partition wall 54 can be deformed into the concave part 57 while at least the circumferential edge 51*a* of the storage part 51 is sealed to the lid member 4.

Therefore, when the lid member 4 is pressed in the direction toward the container body 5, the partition wall 54 is pressed in the direction D1 from the lid member 4 toward the container body 5 as the lid member 4 is stretched. As a result, the partition wall 54 is moved in the direction D1 from the lid member 4 to the container body 5 while the circumferential edge 51*a* of the storage part 51 is sealed to the lid member 4. Consequently, the partition wall 54 is deformed into the concave part 57 recessed in the movement direction of the partition wall 54, i.e., in the direction D1 from the cover member 4 toward the container body 5.

The circumferential edge 51*a* of the storage part 51 is sealed to the lid member 4 by a force allowing the lid member 4 to peel from the partition wall upper edge 54*a* as the partition wall 54 is deformed into the concave part 57. As a result, the lid member 4 is peeled from the partition wall upper edge 54*a* as the partition wall 54 is deformed into the concave part 57, so that the integrated storage chamber 58 is certainly formed while the circumferential edge 51*a* of the storage part 51 is sealed to the lid member 4. To achieve such a sealing force, the sealing force may be weakened only on the partition wall upper edge 54*a*, or the circumferential edge 51*a* of the storage part 51 may be included to achieve the same sealing force. Additionally, not only by adjusting the adhesive force of the lid member, but also by adjusting the configuration of the partition wall upper edge 54*a* such as rounding the shape of the partition wall upper edge 54*a* sealed to the lid member 4 and reducing an adhesion area, the force of the lid member 4 sealing the partition upper wall 54*a* may be adjusted. As described above, the method of implementing the sealing force according to this embodiment is not particularly limited and can appropriately be changed depending on the purpose.

The lid member 4 is made stretchable at least due to plastic deformation. Therefore, the lid member 4 undergoes only plastic deformation or undergoes not only plastic deformation but also elastic deformation to some extent (the lid member 4 of this embodiment is the latter). Thus, when the lid member 4 is stretched, the stretched state remains completely or to some extent. If the lid member 4 undergoes only elastic deformation, the lid member 4 tends to return to an original position even when the lid member 4 is pressed, so that even if the partition wall 54 is deformed into the concave part 57, the concave part 57 may return to the partition wall 54 again as the lid member 4 returns to the original position. In contrast, since the lid member 4 is stretched at least due to plastic deformation in this embodiment, the lid member 4 can be restrained or prevented from returning to the original position, and the concave part 57 is restrained from returning to the partition wall 54 again.

The maximum stretch amount due to plastic deformation of the lid member 4 is set to an amount allowing a position of a portion sealing the partition wall upper edge 54*a* after the plastic deformation to be located above a position of a portion corresponding to the partition wall upper edge 54*a* after deformation of the partition wall 54 into the concave part 57. As a result, even if the lid member 4 is plastically deformed, the position of the lid member 4 is located above the position of the portion corresponding to the partition wall upper edge 54*a* after deformation of the partition wall 54 into the concave part 57 (i.e., the portion to which the lid member 4 is sealed), the portion corresponding to the partition wall upper edge 54*a* can effectively be restrained from being kept sealed to the lid member 4 even after the deformation of the partition wall 54 into the concave part 57.

To achieve the lid member 4 as described above, in this embodiment, an aluminum vapor deposited film having an aluminum film formed on a resin sheet is used as the lid member 4. The aluminum vapor deposited film has high barrier properties against water vapor and gas as well as an aroma retaining property and a light shielding property and is therefore suitable for storage of materials. By applying heat, the film can be bonded to the container body 5 at a considerable degree of adhesion force. In this embodiment, due to combination of both the adhesion force by aluminum vapor deposition and the area of the partition wall upper edge 54*a* bonded to the lid member 4, the force of sealing the partition wall upper edge 54*a* is set to the force allowing the lid member 4 to peel from the partition wall upper edge 54*a* as the partition wall 54 is deformed into the concave part 57. Although various single-layer or multilayer resin sheets can be used, the resin sheet used for the aluminum vapor deposition film may be, for example, a resin sheet composed of three layers of CPP (cast polypropylene), VMCP (aluminum vapor deposition CPP film), and EP (easy-peel film). The resin sheet generally undergoes plastic deformation and can appropriately be changed in strength by changing the thickness and the resin material. Particularly, if the lid member 4 of this embodiment is excessively plastically deformed or easily plastically deformed, the seal of the portion corresponding to the partition wall upper edge 54*a* is hardly peeled during deformation of the container body 5, and therefore, the lid member desirably has a certain degree of strength (such as tensile strength and Young's modulus). The strength is desirably set as appropriate according to a size, a deformation amount, etc. of the container to which the member is attached and, for example, in the case of bonding to the container body 5 by thermal welding, a desired strength can be achieved by performing the thermal welding under the conditions of temperature: 120° C., time: 2.0 seconds, and pressure: 0.4 mps, so that the lid member 4 applicable to a wide range of containers can be acquired. These are illustrative only, and the lid member 4 may be any member at least made of a stretchable sheet material and can appropriately be modified depending on the purpose.

The material used for the container body 5 is preferably a material having high moldability and strength (hardness) to the extent that a predetermined shape can be retained, and, for example, a container made of a resin material is preferable, and an example thereof is LDPE (low density polyethylene). This is because a soft material easily varying in shape makes it difficult to peel only the partition wall upper edge 54*a* from the lid member 4 and, when the shape is changed due to an impact at the time of shipment etc., the sealing of the lid member 4 and the container body 5 may be released due to the deformation. Additionally, if the material has a certain degree of elasticity, the entire container body 5 is bent into an arcuate shape when the partition wall 54 is pressed together with the lid member 4, so that the partition wall 54 can be deformed into the concave part 57 without considerably stretching the lid member 4, which makes the operation easier.

Figure 6:
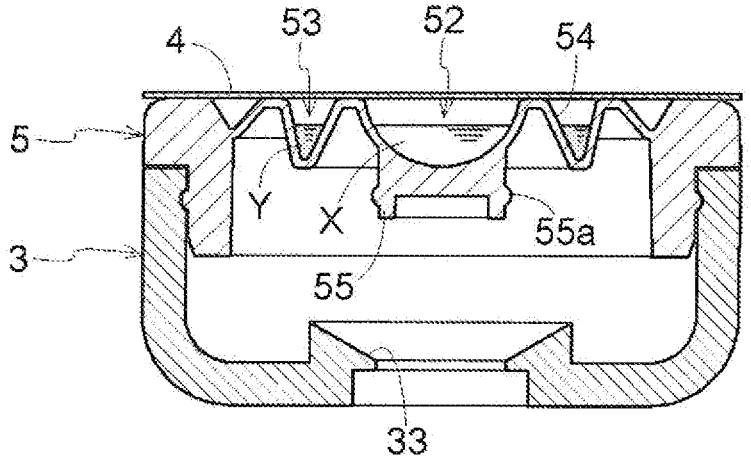
FIG. 6 is a view of a state in which multiple materials are separately stored by the mixing container kit according to the first embodiment.

While the mixing container 2 and the mixing container kit 1 according to this embodiment have the configuration as described above, a usage state of the mixing container 2 and the mixing container kit 1 according to this embodiment will lastly be described. First, as shown in FIG. 6, according to the mixing container 2 of this embodiment, two materials X, Y are stored into the storage chambers 52, 53 while the multiple storage chambers 52, 53 are formed by the partition wall 54 and the lid member 4 is subsequently attached to the container body 5, so that the two materials X, Y are separately stored. A purchase etc. of the mixing container 2 is made by a user while the two materials X, Y are separately stored in this way, and when the two materials X, Y are mixed, the mixing container 2 is mounted on the mounting member 3 to achieve the state shown in FIG. 6.

As shown in FIG. 7, the user presses the partition wall 54 together with the lid member 4 in the direction (the direction D1) opposite to the raised direction of the partition wall 54 with at least the circumferential edge 51*a* of the storage part 51 sealed to the lid member 4, thereby deforming the partition wall 54 into the concave part 57. In this case, as the partition wall 54 is pressed together with the lid member 4, the engaged part 55 disposed on the lower side of the storage chamber 52 is engaged with the engaging part 33 of the mounting member 3 so that the state of the partition wall 54 deformed into the concave part 57 can be retained. Whether the concave part 57 is retained can be determined from the sound generated at the time of engagement. When the multiple storage chambers 52, 53 are deformed into the integrated storage chamber 58, the portion corresponding to the partition wall upper edge 54*a* is peeled from the lid member 4 as shown in FIG. 7, and therefore, the two materials X, Y stored in the storage chambers 52, 53 are stored in a mixed state in the integrated storage chamber 58 (the mixed material is denoted by reference numeral Z). The lid member 4 undergoes plastic deformation at this time and therefore is stretched to some extent as shown in FIG. 8 even after the finger is separated from the lid member 4. In this case, as described above, the partition wall 54 and the storage chamber 52 (the concave groove part) are each concentrically formed in the central portion of the storage part 51, so that the mixed material Z gathers in the concave groove part.

In this embodiment, by using the mounting member 3, the user can perform this pressing operation with one finger as shown in FIG. 7. Specifically, when the mixing container 2 is used alone, an operation of pressing the partition wall 54 together with the lid member 4 must be performed while supporting the container circumferential edge 59, and the operation must basically be performed with both hands. On the other hand, using the mounting member 3 eliminates the need for the operation of supporting the container circumferential edge 59, and the partition wall 54 may be pressed together with the lid member 4 toward the hollow receiving part 31. Therefore, the operation is sufficiently performed with one hand (more specifically, one finger), which makes the operation easier.

Figure 9:
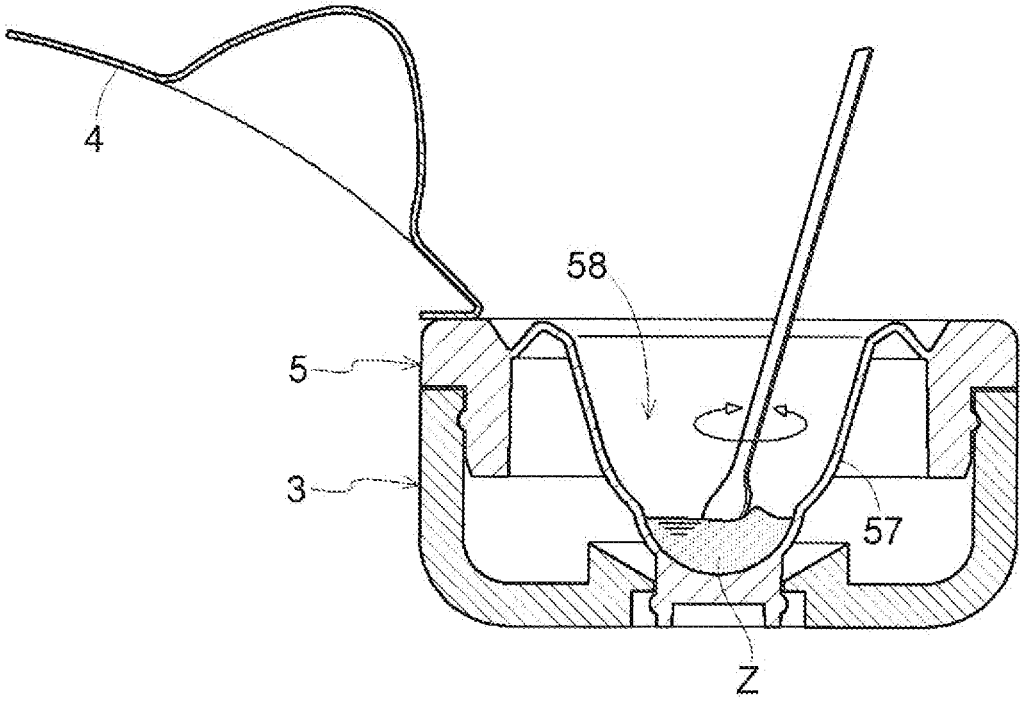
FIG. 9 is a view of a state after the lid member is peeled in the mixing container kit shown in FIG. 8.

Lastly, as shown in FIG. 9, the lid member 4 is peeled, and the mixed material Z gathered in the concave groove part as described above is stirred so that the mixed material Z can be completely mixed and put into a usage state. The mixed material Z is gathered in the concave groove part also in this case and therefore easily mixed.

As described above, according to the mixing container 2 and the mixing container kit 1 of this embodiment, the partition wall 54 is first pressed in the direction opposite to the raised direction (in the direction D1) and is thereby deformed into the concave part 57 to deform the multiple storage chambers 52, 53 into one integrated storage chamber 58, so that the materials X, Y stored in the storage chambers 52, 53 can be mixed in the one integrated storage chamber 58. With such a method, the materials can be restrained from remaining in one of the storage chambers. Since the lid member 4 is a stretchable sheet material, the partition wall 54 can be pressed together with the lid member 4 to deform the partition wall 54 into the concave part 57 with the circumferential edge 51*a* of the storage part 51 sealed to the lid member 4, and the materials X, Y can be made smoothly and safely mixable while reliably preventing the materials X, Y from spilling outside.

The materials X, Y stored in the mixing container 2 of this embodiment are not particularly limited and may obviously be liquid or may be solid (powder, a gel-like substance, a lump, etc., without particular limitation), and since the materials can be mixed in a sealed state, a gas may also be used. The mixing container 2 and the mixing container kit 1 of this embodiment can suitably be used for mixing dental materials, for example, by mixing a powder component and a curing liquid for use as a dental cement; however, the present invention is not limited thereto, and the container and the kit can be used for various applications such as chemicals, medicines, cosmetics, and foods. In this case, the shape and size of the mixing container 2 can be changed depending on the purpose.

Second Embodiment

Figure 10:
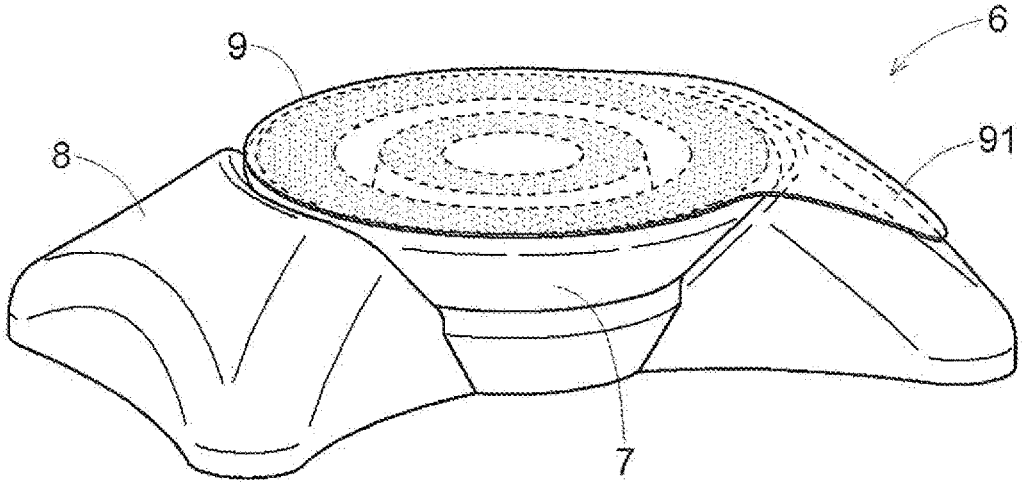
FIG. 10 is a perspective view of a mixing container according to a second embodiment.
Figure 11:
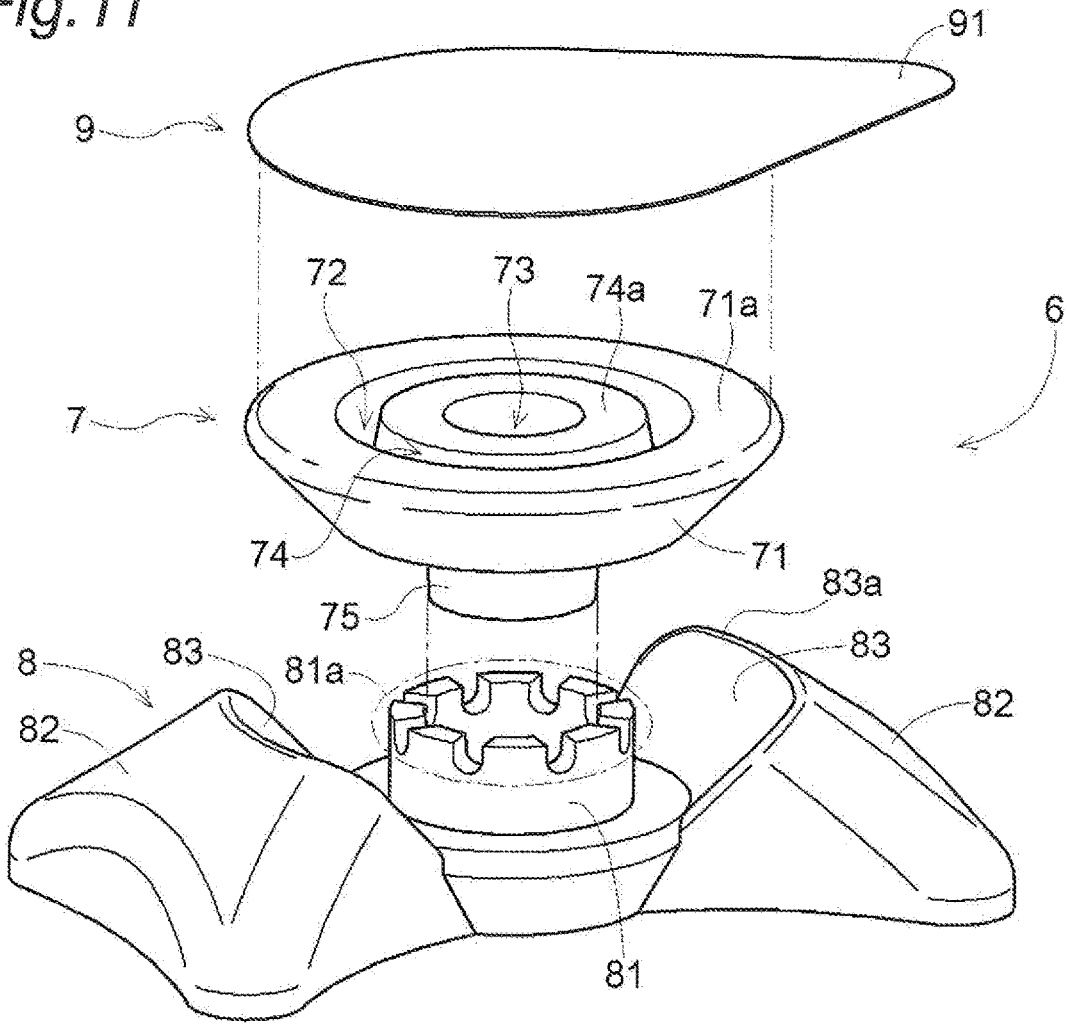
FIG. 11 is an exploded view of a mixing container according to the second embodiment.

A second embodiment of a mixing container, a mixing container kit, and a method of using a mixing container or a mixing container kit according to the present invention will be described with reference to FIGS. 10 to 17. FIGS. 10 and 11 show a mixing container 6 according to the second embodiment, and the mixing container 6 includes a container body 7, a handle part (corresponding to an acting part) 8, and a lid member 9. In the configuration described in the first embodiment, the partition wall 54 is deformed into the concave part 57 by pressing the partition wall 54; however, the mixing container 6 of this embodiment is configured such that a partition wall 74 is deformed into a concave part 76 by pulling the partition wall 74. The configuration of the parts will hereinafter be described.

The container body 7 has the same configuration as the container body 5 of the first embodiment. Specifically, the container body 7 includes a storage part 71 storing materials. The storage part 71 has the one partition wall 74 formed such that a portion of a wall surface forming the storage part 71 is raised toward a storage space. Multiple storage chambers 72, 73 capable of separately storing the materials are formed by the partition wall 74 in the storage part 71. The partition wall 74 is configured to be relatively movable in a direction opposite to a raised direction (in a direction toward the outside of the storage space) with respect to a remaining portion of an inner wall surface and to be deformable into the concave part 76 recessed toward the opposite direction side from the remaining portion of the inner wall surface when relatively moved in the opposite direction. The remaining portion of the inner wall surface is a portion including a circumferential edge 71*a* of the storage part 71.

Therefore, when moved in a direction D2 from the lid member 9 toward the container body 7 with the circumferential edge 71*a* of the storage part 71 sealed to the lid member 9, the partition wall 74 is deformable into the concave part 76 recessed in the movement direction of the partition wall 74, i.e., the movement direction D2 from the lid member 9 toward the container body 7.

When the partition wall 74 is deformed into the concave part 76, the multiple storage chambers 72, 73 formed by the partition wall 54 are deformed into one integrated storage chamber 58. As in the container body 5 of the first embodiment, the partition wall 74 is a portion of the wall surface forming the storage part 71 raised in a dome shape toward the lid member 9. The partition wall 74 has one concave groove part formed as the storage chamber 72 such that a portion of the partition wall 74 is recessed in a concave shape. The partition wall 74 and the storage chamber 72 (concave groove part) are each concentrically formed in a central portion of the storage part 71. As a result, the storage chamber 73 is an annular storage chamber. A portion 75 of the partition wall 74 constituting an outer wall surface of the storage chamber 72 is formed in a columnar shape and functions as an engaged part engaged with the handle part 8.

In this embodiment, the capacity of the storage chamber 73 formed in a space between a partition wall upper edge 74*a* and the storage part circumferential edge 71*a* is formed larger than the capacity of the storage chamber 72 formed in a space inside the partition wall upper edge 74*a*. Such a balance of the capacities of the storage chambers 72, 73 facilitates suppression of a change in capacity when the partition wall 74 is deformed into the concave part 76, and a negative pressure generated after the deformation can be suppressed. In the partition wall 74, the wall thickness of the upper edge portion 74*a* of the partition wall 74 is formed thicker than the wall thickness of a wall surface portion 74*b* outside the upper edge portion 74*a*. Such a balance of wall thickness enhances the strength of the upper edge portion 74*a* supporting the wall surface portion 74*b* after deformation into the concave part 76, and the state of the partition wall 74 deformed into the concave part 76 is easily retained. The wall thickness of the circumferential edge portion 71*a* of the storage part 71 is formed thicker than the wall thickness of the wall surface portion 74*b* on the outside of the partition wall 74. This can enhance the strength of the wall thickness of the circumferential edge portion 71*a* of the storage part 71, so that an outer circumferential portion of the storage part 71 can be restrained from deforming due to the deformation of the partition wall 74. As described later, even when the outer circumferential portion of the storage part 71 is pinched with fingers, the storage part 71 is hardly deformed, and the operation is easily performed.

Figure 12A:
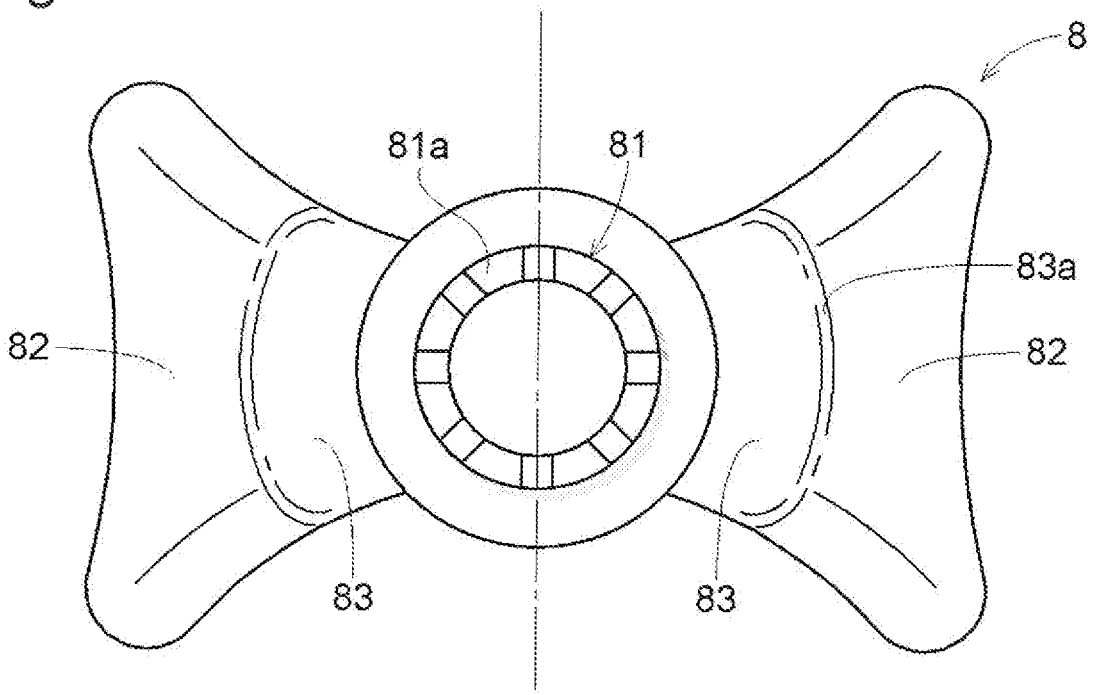
FIG. 12A is a plane view of a handle part according to the second embodiment.
Figure 12B:
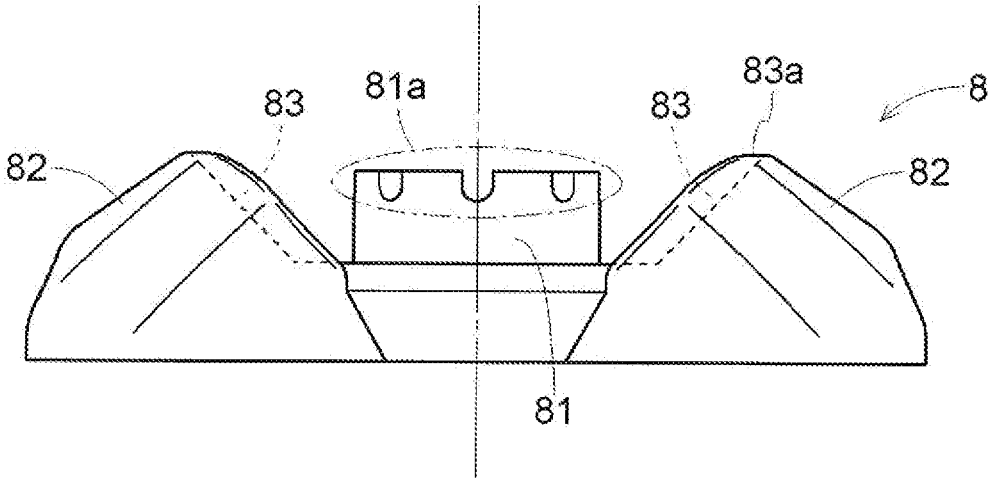
FIG. 12B is a front view of the handle part according to the second embodiment.
Figure 13A:
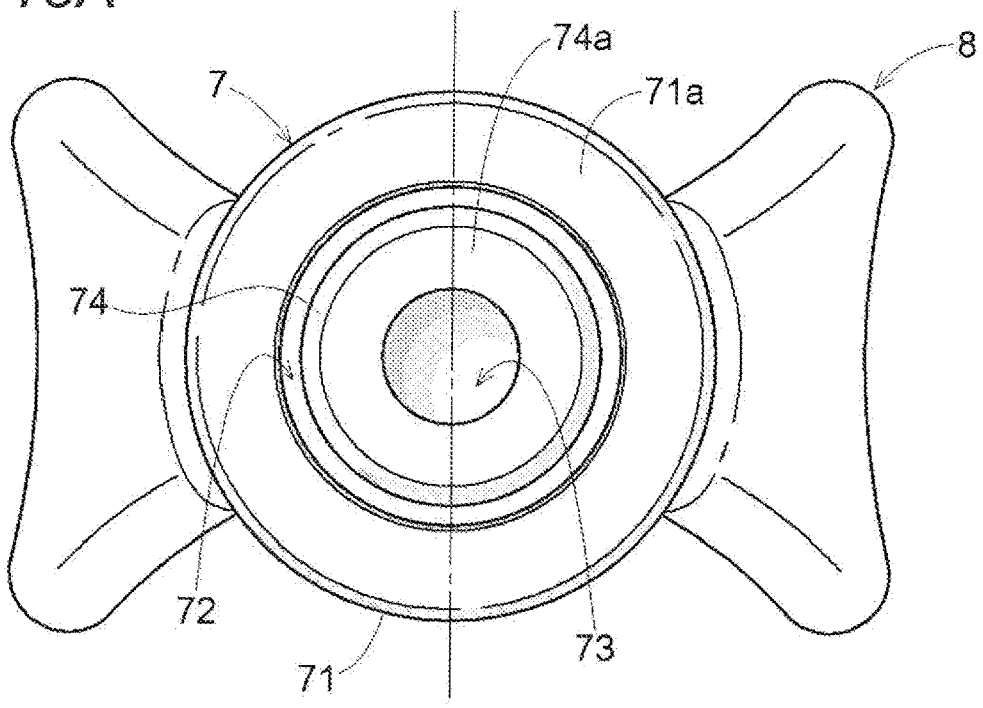
FIG. 13A is a plane view of the mixing container according to the second embodiment.
Figure 13B:
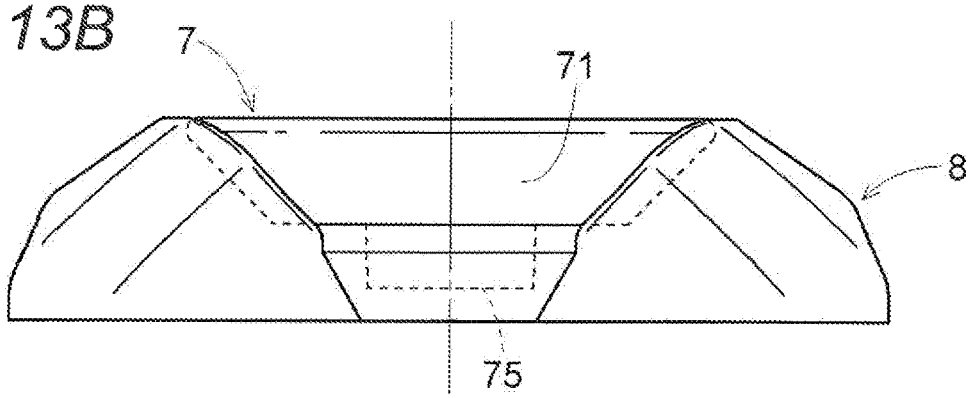
FIG. 13B is a front view of the mixing container according to the second embodiment.
Figure 13C:
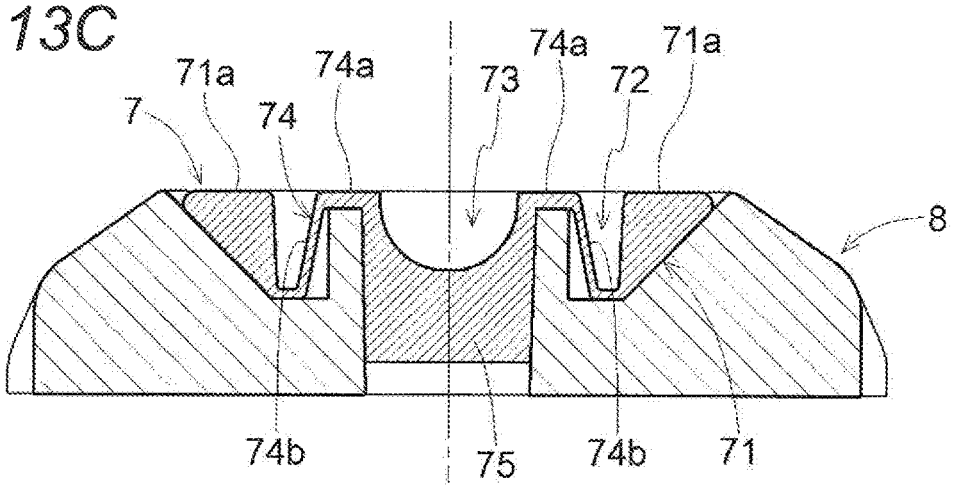
FIG. 13C is a front cross-sectional view of the mixing container according to the second embodiment.

As shown in FIGS. 11, 12A, and 12B, the handle part 8 includes a coupling part 81 coupled to the partition wall 74 (specifically, the engaged part 75) and operating parts 82 operated by a user. As the operating parts 82 relatively moves in a direction opposite to the raised direction of the partition wall 74 with respect to the container body 7, the partition wall 74 relatively moves together with the coupling part 81 in the direction opposite to the raised direction with respect to the remaining portion of the inner wall surface.

Figure 14A:
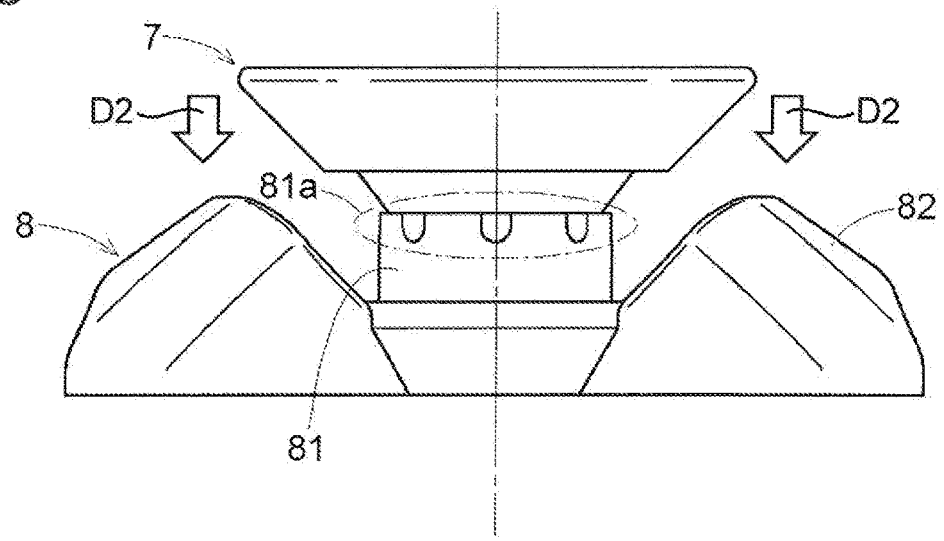
FIG. 14A is a front view of a state in which the partition wall of the mixing container according to the second embodiment is deformed into a concave part.
Figure 14B:
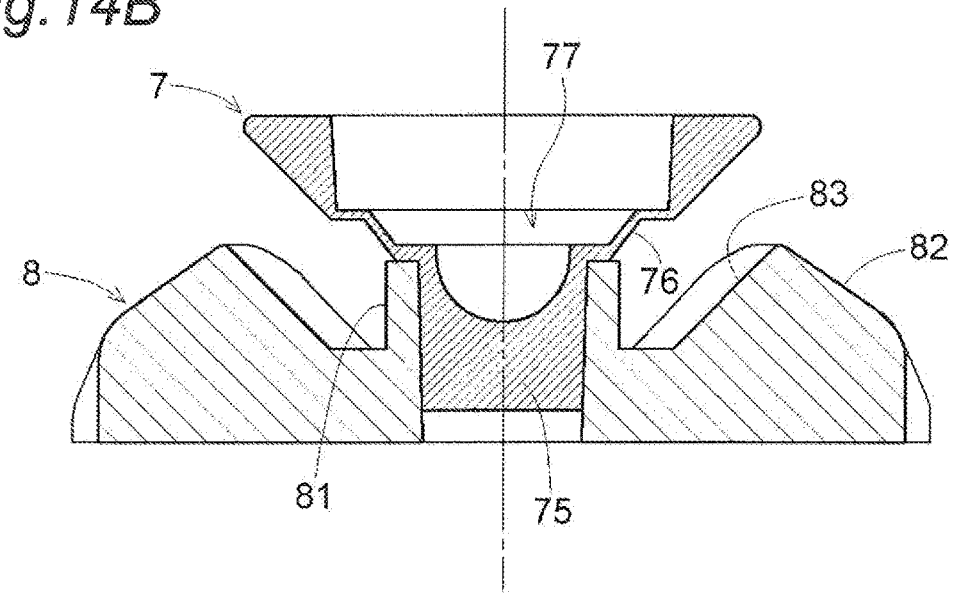
FIG. 14B is a front cross-sectional view of a state in which the partition wall of the mixing container according to the second embodiment is deformed into a concave part.

In other words, as the operating parts 82 relatively move in the direction D2 from the lid member 9 toward the container body 7 with respect to the container body 7, the partition wall 74 moves together with the coupling part 81 in the direction D2 from the lid member 9 toward the container body 7 (see FIG. 14A).

Therefore, by pulling the operating parts 82 in a direction opposite to the raised direction of the partition wall 74 with respect to the container body 7, i.e., in the direction D2 from the lid member 9 toward the container body 7, the partition wall 74 coupled to the coupling part 81 is pulled in the direction opposite to the raised direction, i.e., in the direction D2 from the lid member 9 toward the container body 7. As a result, the partition wall 74 can be deformed into the concave part 76 recessed in the movement direction of the partition wall 74, i.e., in the direction D2 from the cover member 9 toward the container body 7.

The coupling part 81 is formed into a cylindrical shape slightly smaller in inner diameter than the engaged part 75 of the container body 7. By inserting the engaged part 75 inside the coupling part 81, the engaged part 75 is firmly coupled to the coupling part 81. As shown in FIGS. 11 to 14, the coupling part 81 includes a concealed portion 81*a* (in this embodiment, a portion at the leading end of the coupling part 81) that is not exposed outside when the partition wall 74 is not deformed into the concave part 76 (see FIGS. 13A, 13B, and 13C) and that is exposed outside when the partition wall 74 is deformed into the concave part 76 (see FIGS. 14A and 14B). The concealed portion 81*a* has an appearance distinguishable from the other portion of the coupling part 81 and, although the appearance is not particularly limited as long as the portion can be distinguished from the other portion because of coloring, a characteristic shape, etc., the concealed portion 81*a* has a jagged shape in this embodiment.

Figure 16:
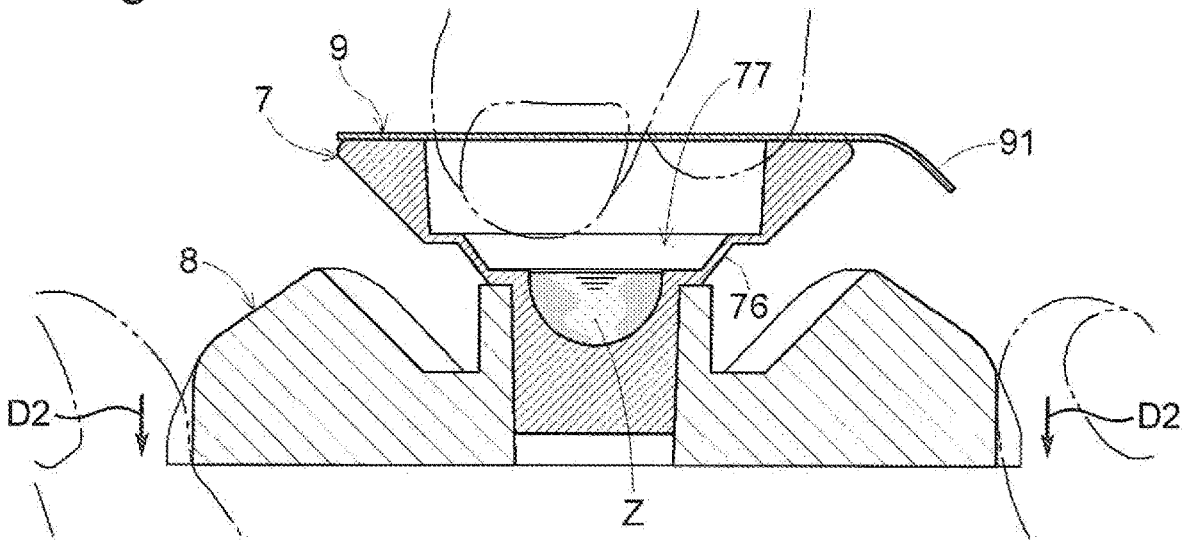
FIG. 16 is a view of a state in which the handle part is relatively moved in the opposite direction with respect to a container body in the mixing container shown in FIG. 15.

Since the operating parts 82 are made up of a pair of members extending from the coupling part 81 to the sides opposite to each other, the mixing container 6 can stably be placed on a floor surface etc. with a pair of the operating parts 82, 82 extending to the sides opposite to each other, and an acting force can be applied from both sides of the container body 7, so that the operation can stably be performed. More specifically, in this embodiment, the operating parts 82 have a shape that extends point symmetrically about the coupling part 81 and that becomes wider as a distance from the coupling part 81 increases, forming a ribbon-like shape in planar view. Since the operating parts 82 extend point symmetrically about the coupling part 81, the operating parts 82 do not exist in the direction perpendicular to the extending directions of the operating parts 82 with respect to the coupling part 81 and, as shown in FIG. 16, the container body 7 can be grasped in the direction perpendicular to the extending directions of the operating parts 82. Therefore, the operating parts 82 do not become an obstacle at the time of operation, and the operation is easily performed. Since the operating parts 82 have a shape that becomes wider as the distance from the coupling part 81 increases, the end portion sides of the operating parts 82 become wider so that a force is easily applied.

The handle part 8 includes receiving parts 83 each formed into a shape corresponding to a portion of the container body 7 (portion overlapping with the operating part 82 in planar view) in a portion of the operating part 82 facing the container body 7 for receiving the container body 7 coupled to the coupling part 81. The receiving parts 83 are configured such that a circumferential edge 83*a* of the receiving part 83 and the container body 7 are flush with each other when the container body 7 is received. As a result, the container body 7 can be supported by the receiving parts 83 to suppress the relative movement of the container body 7 such as shaking with respect to the handle part 8, and the seal of the upper edge 74*a* of the partition wall 74 is restrained from being carelessly peeled.

The lid member 9 is attached to the container body 7 to seal the circumferential edge 71*a* of the storage part 71 and the upper edge 74*a* of the partition wall 74 partitioning the multiple storage chambers 72, 73 such that the multiple storage chambers 72, 73 are separately sealed. As described later, in this embodiment, the handle part 8 can be used for relatively moving the partition wall 74 in the direction opposite to the raising direction (in the direction D2) with respect to the remaining portion of the inner wall surface while retaining the state in which the circumferential edge 71*a* of the storage part 71 is sealed to the lid member 9, and therefore, unlike the first embodiment, it is not necessary to stretch the lid member 9. Thus, in this embodiment, the lid member 9 can be made of a non-stretchable or less stretchable material. The lid member 9 includes a tab 91. The tab 91 is disposed along the handle part 8 (more specifically, the operating part 82). As a result, the tab 91 does not become an obstacle at the normal time (in the state of FIGS. 13A, 13B, 13C, and 15), and when the partition wall 74 is deformed into the concave part 76 (in the state of FIGS. 14A, 14B, and 16), the tab 91 is separated from the handle part 8 due to the relative movement of the operating part 82, so that the tab 91 is easily grasped. As described above, in this embodiment, the tab 91 can be placed in an easy-to-use state only when necessary.

Figure 15:
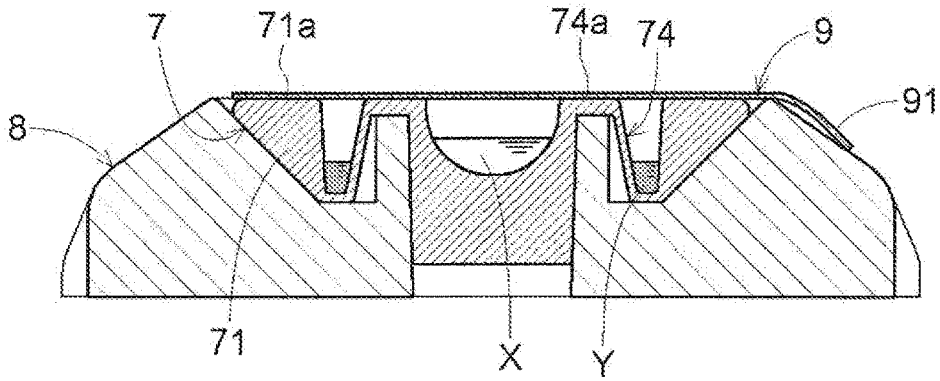
FIG. 15 is a view of a state in which multiple materials are separately stored by the mixing container according to the second embodiment.

A usage state of the mixing container 6 according to this embodiment will be described. First, in the mixing container 6 according to this embodiment, as in the first embodiment, as shown in FIG. 15, two materials X, Y are stored in the storage chambers 72, 73, and the lid member 9 is subsequently attached to the container body 7, so that the two materials X, Y can separately be stored. In this embodiment, as shown in FIG. 16, the user holds the pair of the operating parts 82 with fingers and pulls the operating parts 82 (the handle part 8) downward while grasping the container body 7, or holds and pulls the container body 7 upward with fingers while grasping the pair of the operating parts 82, thereby relatively moving the operating parts 82 downward with respect to the container body 7. As a result, only the partition wall 74 of the container body 7 can relatively be moved with respect to the remaining portion of the inner wall surface of the storage part 71 in the direction (the direction D2) opposite to the raised direction of the partition wall 74.

In other words, by pulling the operating parts 82 downward, the coupling part 81 coupled to the partition wall 74 is moved downward. In this case, the coupling part 81 pulls the partition wall 74 downward. As a result, the partition wall 74 relatively moves downward with respect to the remaining portion of the inner wall surface.

Figure 17:
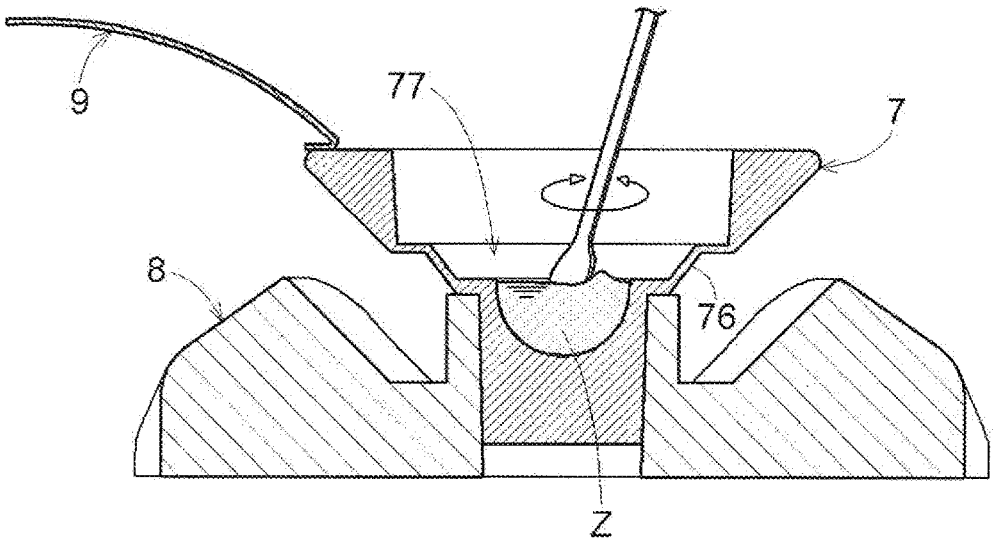
FIG. 17 is a view of a state after the lid member is peeled in the mixing container shown in FIG. 16.

Through such a movement of the partition wall 74, the partition wall 74 can be deformed into the concave part 76 with the circumferential edge 71*a* of the storage part 71 sealed to the lid member 9. As a result, the two materials X, Y stored in the storage chambers 72, 73 are stored in a mixed state in the integrated storage chamber 77 to form the mixed material Z. As shown in FIG. 17, the lid member 9 is then peeled and the mixed material Z is stirred to completely mix the mixed material Z.

As described above, according to the mixing container 6 of this embodiment, as in the first embodiment, the partition wall 74 can be deformed into the concave part 76 with the circumferential edge 71*a* of the storage part 71 sealed to the lid member 9, and the materials X, Y can be made smoothly and safely mixable while reliably preventing the materials X, Y from spilling outside.

This embodiment can employ the configuration described in the first embodiment (e.g.,) in addition to the configuration described above. Conversely, the first embodiment can employ the configuration described in this embodiment (e.g., the relationship of capacity between the storage chambers 72, 73, and the relationship of wall thickness of the parts of the container body 7).

Third Embodiment

Figure 18:
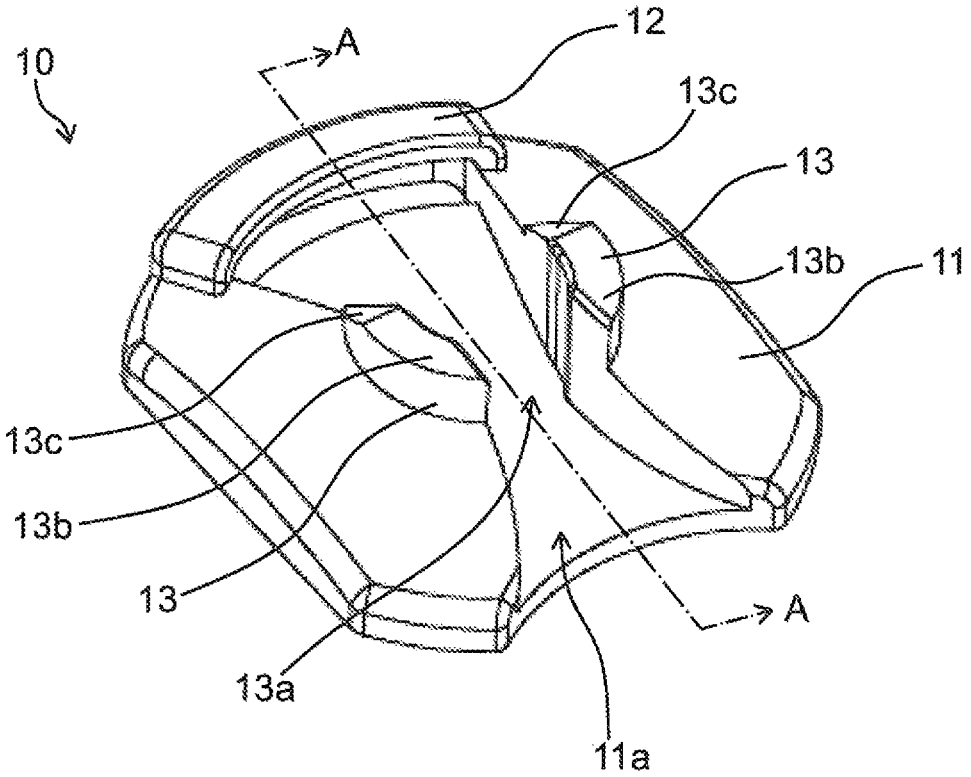
FIG. 18 is a perspective view of the assistive device according to a third embodiment.
Figure 19:
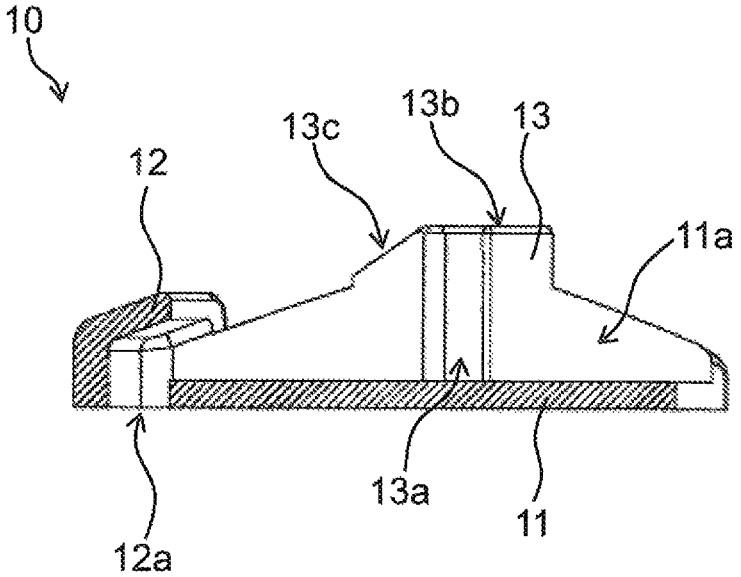
FIG. 19 is a cross-sectional view taken along a line A-A of the assistive device shown in FIG. 18.

An assistive device of a mixing container according to the present invention will be described as a third embodiment with reference to FIGS. 18 and 19. FIGS. 18 and 19 show an assistive device 10 according to the third embodiment. The assistive device 10 is a device for moving the partition wall 74 of the container body 7 of the mixing container 6 of the second embodiment in a direction from the lid member 9 toward the container body 7.

As shown in FIGS. 18 and 19, the assistive device 10 includes a base 11, a hook part 12, and a convex part 13. The configuration of the parts will hereinafter be described.

The base 11 is a portion serving as abase of the assistive device 10 and is formed of a plate-like member. On the upper surface side of the base 11, abase concave part 11*a* is disposed. The base concave part 11*a* is formed into a shape capable of accommodating the handle part 8 of the mixing container 6. The base concave part 11*a* is connected to the hook part 12.

In this embodiment, the base concave part 11*a* is formed along the shape of the handle part 8 of the mixing container 6. As a result, when the mixing container 6 is attached to the assistive device 10, the mixing container 6 can easily be positioned by the base concave part 11*a*.

The hook part 12 is a position disposed on the base 11 and engaged with one end of the handle part 8 of the mixing container 6. Specifically, the hook part 12 is formed at one end of the base 11, extending toward the upper surface side of the base 11 and bending toward the center side of the base 11. Therefore, the hook part 12 has a cross section formed into an inverted L shape. The space inside the hook part 12 communicates with the base concave part 11*a*. A through-hole 12*a* penetrating through the base 11 is formed inside the hook part 12.

By placing one end of the handle part 8 of the mixing container 6 in the through-hole 12*a* through the inside of the hook part 12, the one end of the handle part 8 can be engaged with the hook part 12. As a result, the one end of the handle part 8 is fixed to the hook part 12.

The convex part 13 is a portion disposed on the base 11 and supporting a portion of the container body 7 of the mixing container 6 at a position separated from the hook part 12 in the thickness direction of the base 11. Specifically, the convex part 13 is disposed to project on the upper surface side of the base 11. In this embodiment, the convex part 13 supports a portion of the container body 7 exposed from the handle part 8 as the portion of the container body 7. The portion of the container body 7 exposed from the handle part 8 is a portion of the container body 7 exposed from the handle part 8 as seen from the lower surface side of the mixing container 6.

The convex part 13 is provided with a groove 13*a* allowing the movement of the partition wall 74 of the container body 7 of the mixing container 6. Specifically, the convex part 13 is formed of a pair of members projecting in a direction from a lower surface to an upper surface of the base 11 and is divided by the groove 13*a*. The pair of members are symmetrically formed with the groove 13*a* interposed therebetween. The groove 13*a* is connected to the base concave part 11*a*.

The convex part 13 has an upper surface 13*b* and an inclined surface 13*c* inclined from the upper surface 13*b* toward the hook part 12. The upper surface 13*b* and the inclined surface 13*c* of the convex part 13 are formed at positions higher than the hook part 12. The upper surface 13*b* and the inclined surface 13*c* of the convex part 13 come into contact with a portion of the container body 7 of the mixing container 6 (a portion exposed from the handle part 8). The convex part 13 can support the portion of the container body 7 by bringing the portion of the container body 7 into contact with the upper surface 13*b* and the inclined surface 13*c*.

When the convex part 13 supports the portion of the container body 7 while the one end of the handle part 8 of the mixing container 6 is engaged with the hook part 12, the other end of the handle part 8 can be retained at a position separated from the base 11. Therefore, the handle part 8 can be attached obliquely to the assistive device 10.

With such a configuration, by moving the other end of the handle part 8 in the direction toward the base 11, the partition wall 74 of the container body 7 can relatively be moved in the groove 13*a* of the convex part 13 in the direction from the lid member 9 to the container body 7 with respect to the portion of the container body 7.

A method of using the assistive device 10 will be described in detail with reference to FIGS. 20 to 23. FIGS. 20 to 23 show the method of using the assistive device 10. In FIGS. 20 to 23, some of the components constituting the mixing container 6 are omitted and simplified for ease of description.

Figure 20:
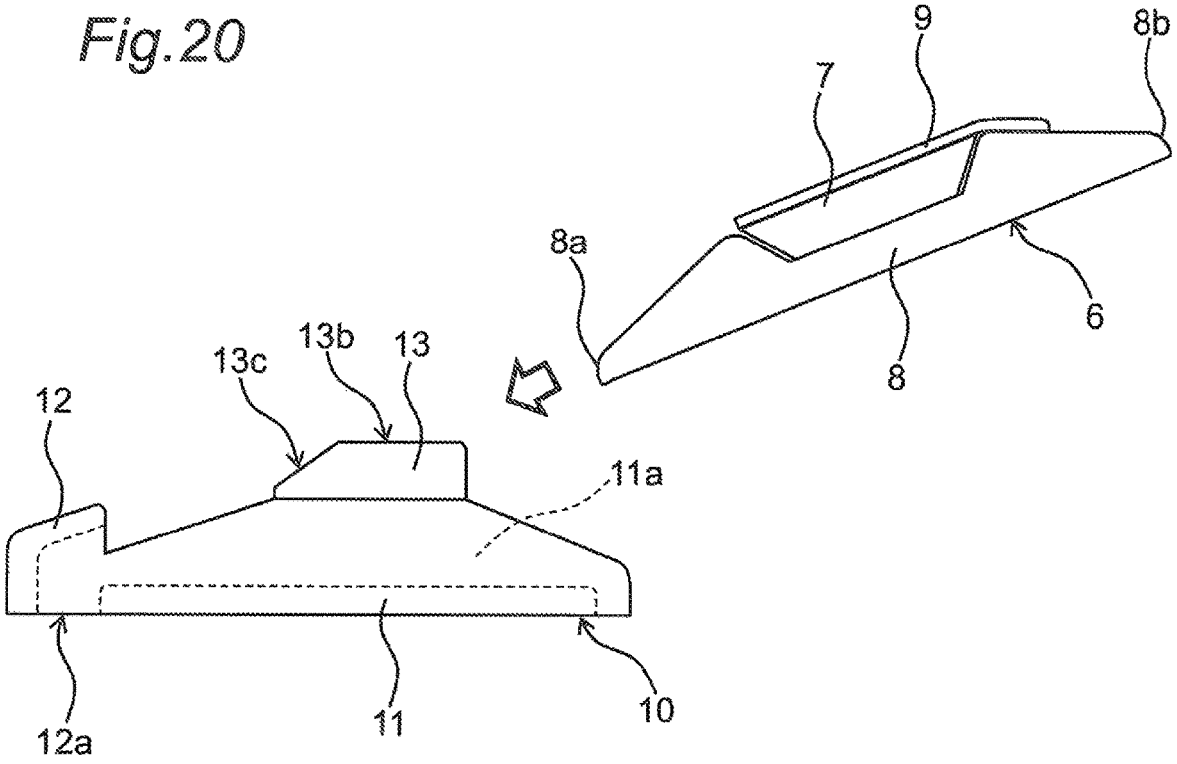
FIG. 20 is a view of a method of using the assistive device according to the third embodiment.

As shown in FIG. 20, one end 8*a* of the handle part 8 of the mixing container 6 is obliquely inserted toward the inside of the hook part 12 to attach the mixing container 6 to the assistive device 10. At this point, the mixing container 6 is positioned by the base concave part 11*a*. Specifically, the handle part 8 of the mixing container 6 is placed inside the base concave part 11*a*. As a result, the handle part 8 of the mixing container 6 is positioned by side walls forming the base concave part 11*a*.

Figure 21:
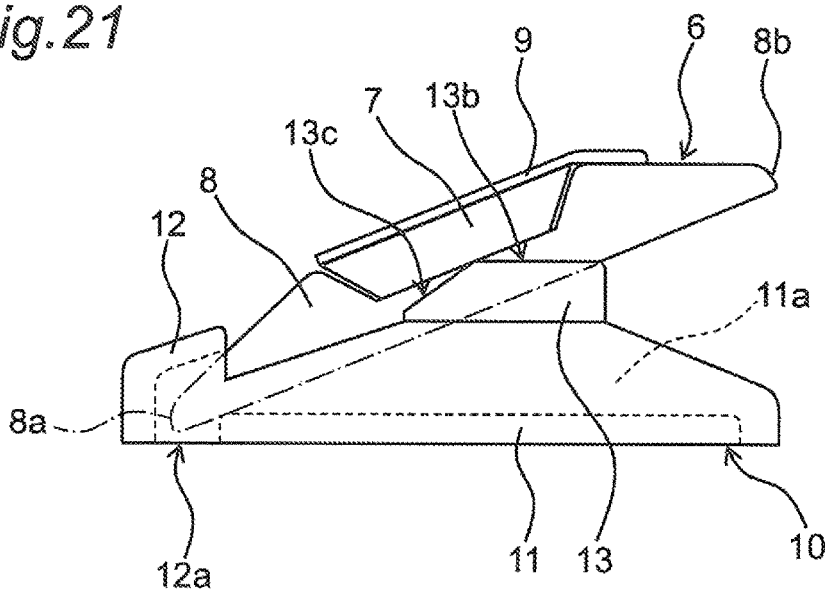
FIG. 21 is a view of a method of using the assistive device according to the third embodiment.

As shown in FIG. 21, when the mixing container 6 is attached to the assistive device 10, the one end 8*a* of the handle part 8 of the mixing container 6 is placed in the through-hole 12*a* and engaged with the hook part 12. The portion of the container body 7 of the mixing container 6 (the portion of the container body 7 exposed from the handle part 8) comes into contact with the convex part 13 at a position higher than the hook part 12. As a result, the one end 8*a* of the handle part 8 is fixed by the hook part 12, while the portion of the container body 7 exposed from the handle part 8 is supported by the convex part 13. At this point, the one end 8*a* of the handle part 8 and the other end 8*b* on the opposite side are retained at a position separated from the base 11. The handle part 8 and the partition wall 74 of the container body 7 are not supported by the convex part 13 and are placed in the groove 13*a* of the convex part 13.

Figure 22:
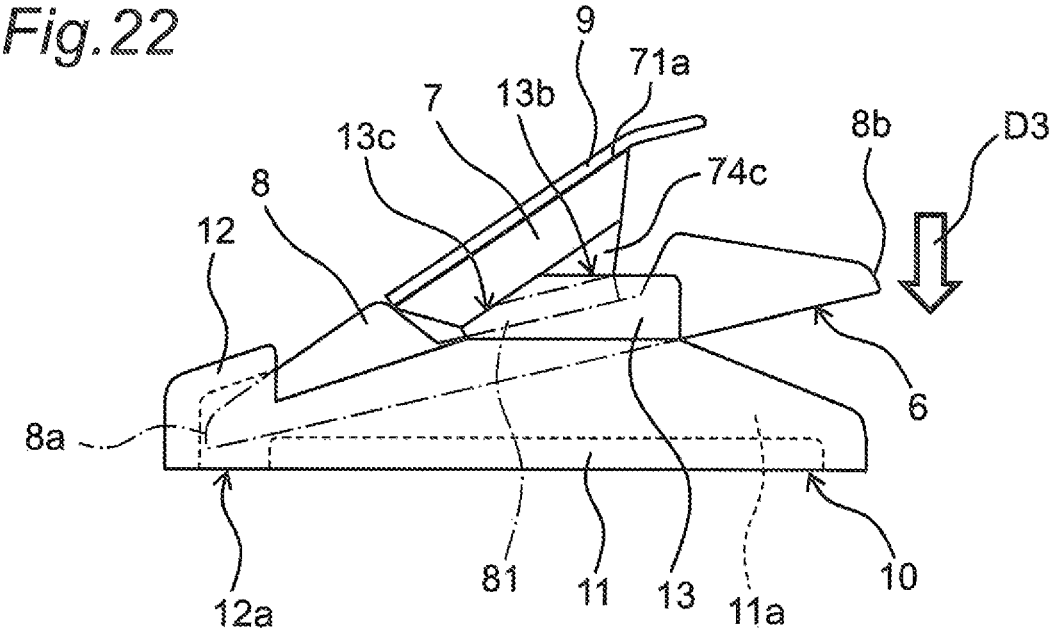
FIG. 22 is a view of a method of using the assistive device according to the third embodiment.

As shown in FIG. 22, the other end 8*b* of the handle part 8 of the mixing container 6 is moved in a direction D3 toward the base 11, i.e., downward. As a result, the portion of the container body 7 is supported by the inclined surface 13*c* of the convex part 13. When the other end 8*b* of the handle part 8 is moved in the direction D3 with the portion of the container body 7 supported by the inclined surface 13*c*, the coupling part 81 coupled to the partition wall 74 is moved in the direction D3 in the groove 13*a* of the convex part 13. As the coupling part 81 moves, a first portion 74*c* of the partition wall 74 located on the other end 8*b* side of the handle part 8 relatively moves in the direction from the lid member 9 toward the container body 7 with respect to the circumferential edge 71*a* of the storage part 71.

Therefore, by moving the other end 8*b* of the handle part 8 in the direction D3 with the portion of the container body 7 supported by the inclined surface 13*c* of the convex part 13, the first portion 74*c* of the partition wall 74 can relatively be moved in the direction from the lid member 9 toward the container body 7 with respect to the portion of the container body 7 supported by the inclined surface 13*c* of the convex part 13.

Figure 23:
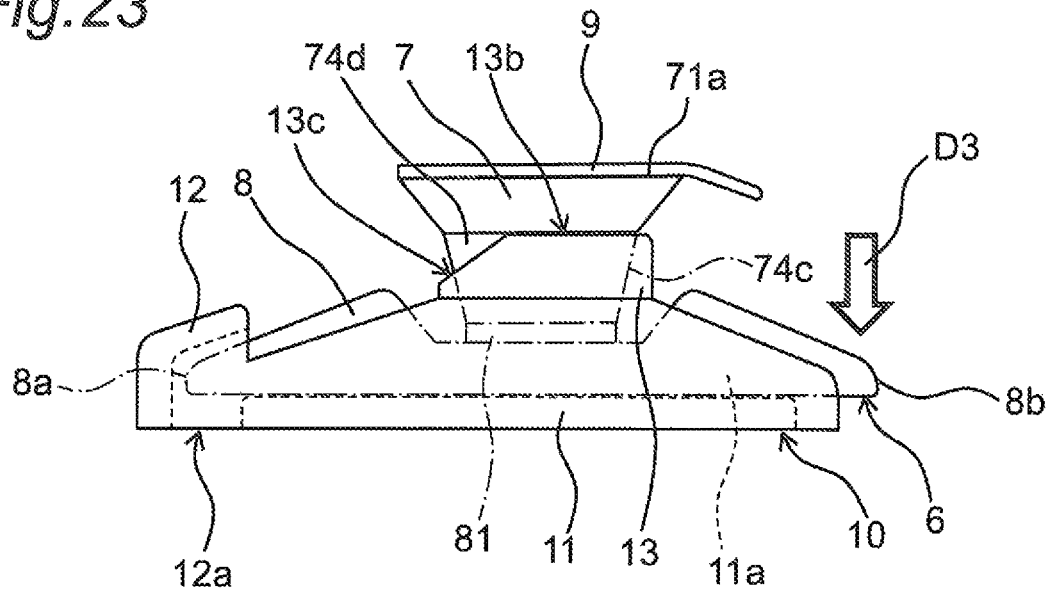
FIG. 23 is a view of a method of using the assistive device according to the third embodiment.

As shown in FIG. 23, the other end 8*b* of the handle part 8 is further moved in the direction D3 toward the base 11. After the first portion 74*c* of the partition wall 74 moves in the direction D3, the portion of the container body 7 is supported by the upper surface 13*b* of the convex part 13. As a result, a second portion 74*d* of the partition wall 74 located on the one end 8*a* side of the handle part 8 relatively moves in the direction from the lid member 9 toward the container body 7 with respect to the circumferential edge 71*a* of the storage part 71.

Therefore, by further moving the other end 8*b* of the handle part 8 in the direction D3 with the portion of the container body 7 supported by the upper surface 13*b* of the convex part 13, the second portion 74*d* of the partition wall 74 can relatively be moved in the direction from the lid member 9 toward the container body 7 with respect to the portion of the container body 7 supported by the upper surface 13*b* of the convex part 13.

According to the assistive device 10 of this embodiment, the partition wall 74 of the container body 7 of the mixing container 6 can easily be moved. For example, after the mixing container 6 is attached to the assistive device 10, the other end 8*b* of the handle part 8 of the mixing container 6 is moved in the direction D3 toward the base 11 with a user's finger. Therefore, the partition wall 74 can relatively be moved in the direction from the lid member 9 toward the container body 7 with respect to the portion of the container body 7 supported by the convex part 13. In this way, by using the assistive device 10, the partition wall 74 can easily be moved by a simple operation.

By utilizing the upper surface 13*b* and the inclined surface 13*c* of the convex part 13, the assistive device 10 gradually pulls the partition wall 74 from the first portion 74*c* of the partition wall 74 located on the other end 8*b* side of the handle part 8 to the second portion 74*d* of the partition wall 74 located on the one end 8*a* side of the handle part 8. Therefore, the partition wall 74 can be moved with a smaller force as compared to when the entire partition wall 74 is pulled at one time.

Since the container body 7 is supported by the inclined surface 13*c* inclined toward the hook part 12, the partition wall 74 can be pulled in an oblique direction with respect to the direction D3 toward the base 11. Therefore, the partition wall 74 can be moved with a smaller force as compared to when the partition wall 74 is simply pulled in the direction D3.

Other Embodiments

Lastly, other embodiments of the mixing container, the mixing container kit, and the method of using the mixing container or the mixing container kit, and the assistive device according to the present invention will be described. The configuration disclosed in each of the following embodiments can be applied in combination with the configurations disclosed in the other embodiments as long as no contradiction occurs.

(1) In the configurations described as examples in the embodiments, the lid member 4 formed of a stretchable sheet material is used as the acting part for pressing the partition wall 54 together with the lid member 4 to relatively move the partition wall 54 in the opposite direction, and the handle part 8 including the coupling part 81 and the operating part 82 is used as the acting part to relatively move the operating part 82 in the opposite direction with respect to the container body 7 so that the partition wall 74 is relatively moved together with the coupling part 81 with respect to the remaining portion of the inner wall surface of the portion 71 in the direction opposite to the raised direction. However, the embodiments of the present invention are not limited thereto, and various parts can be used as the acting part as long as the partition wall 54, 74 can relatively be moved in the direction opposite to the raised direction with respect to the remaining portion of the inner wall surface forming the storage parts 51, 71, i.e., the partition walls 54, 74 can be moved in the directions D1, D2 from the lid members 54, 57 toward the container bodies 5, 7, in accordance with the action from the user while keeping the state of the circumferential edges 51*a*, 71*a* of the storage parts 51, 71 sealed to the lid members 4, 9.

(2) In the configuration described as an example in embodiments, two storage chambers are disposed. However, the embodiments of the present invention are not limited thereto, and three or more storage chambers may be formed by the partition walls 54, 74. For example, a conceivable method may include forming multiple partition walls such as the partition walls 54, 74 provided with the concave groove parts in the embodiments described above, or providing the partition walls 54, 74 with one or more annular concave groove parts outside the concave groove parts serving as the storage chambers 52, 72 to utilize the concave groove parts as the storage chambers so that three or more storage chambers are formed by the partition walls 54, 74. Alternatively, the dome-shaped partition walls 54, 74 may be provided with three or more concave groove parts arranged on the circumference so that the concave groove parts are utilized as the storage chambers. However, the method of forming three or more storage chambers by the partition walls 54, 74 is not limited thereto, and various methods can be used as needed depending on the purpose.

(3) In the configuration described as an example in the embodiments, the upper edges 54*a*, 74*a* of the partition walls 54, 74 are not coupled to the circumferential edges 51*a*, 71*a* of the storage parts 51, 71, and at least one storage chamber is formed in a space inside the upper edges 54*a*, 74*a* of the partition walls 54, 74, while at least one storage chamber is formed in a space between the upper edges 54*a*, 74*a* of the partition walls 54, 74 and the circumferential edges 51*a*, 71*a* of the storage parts 51, 71. More specifically, in the configuration described as an example, the partition walls 54, 74 are raised in a dome shape with the concave groove part disposed as one of the storage chambers in the partition walls 54, 74, and the partition walls 54, 74 and the concave groove part are each concentrically formed in the central portion of the storage parts 51, 71. However, the embodiments of the present invention are not limited thereto. The partition walls 54, 74 and the concave groove part may not be disposed in the central portion of the storage parts 51, 71 or may not concentrically be disposed. The partition walls 54, 74 may not have a dome shape, and the partition walls 54, 74 may separate the storage parts 51, 71 into multiple storage spaces without disposing a concave groove part as one of the storage chambers in the partition walls 54, 74. The upper edges 54*a*, 74*a* of the partition walls 54, 74 may be coupled to the circumferential edges 51*a*, 71*a* of the storage parts 51, 71 without departing from the spirit of the present invention.

(4) In the configuration described as an example in the embodiments, the partition wall 54 is pressed together with the lid member 4 by using the mixing container 2 set in the mounting member 3. However, the embodiments of the present invention are not limited thereto, and the mixing container 2 may solely be used, and the partition wall 54 may be pressed together with the lid member 4 by using the mixing container 2 alone.

(5) In the configuration described as an example in the embodiments, for the retaining mechanism retaining the concave part 57 at the position when the partition wall 54 is deformed into the concave part 57, the engaged part 55 is provided on the lower side of the storage chamber 52 of the container body 5 and the engaging part 33 is disposed on the mounting member 3. However, the embodiments of the present invention are not limited thereto. For example, for the retaining mechanism, other configurations capable of retaining the concave part 57 at the position may be disposed instead of the engaged part 55 and the engaging part 33. The engaged part 55 or other configurations serving as the retaining mechanism may be disposed at other positions without limitation to the lower side of the storage chamber 52, and the engaging part 33 or other configurations serving as the retaining mechanism may be disposed at positions corresponding thereto on the mounting member 3. Alternatively, the retaining mechanism may not be disposed on the mixing container 2 and the mounting member 3.

(6) The configuration/shape of the handle part 8 shown in the second embodiment are illustrative only, and the embodiments of the present invention are not limited thereto. For example, the handle part 8 may not include the receiving part 83, and the coupling part 81 may not include the concealed portion 81*a*, so that the configuration/shape of the handle part 8 can be changed as needed.

(7) The relationship of capacity between the storage chambers 72, 73 and the relationship of wall thickness of the parts of the container body 7 described in the second embodiment are illustrative only, and the embodiments of the present invention are not limited thereto and can be changed as needed.

(8) The relationship of capacity between the storage chambers 72, 73 and the relationship of wall thickness of the parts of the container body 7 described in the second embodiment are illustrative only, and the embodiments of the present invention are not limited thereto and can be changed as needed.

(9) In the configuration described as an example in the second embodiment, the cover member 9 includes the tab 91, and the tab 91 is disposed along the handle part 8. However, the embodiments of the present invention are not limited thereto, and the lid member 9 may not include the tab 91, and the tab 91 may not be disposed along the handle part 8.

(10) In the configuration described as an example in the third embodiment, the base 11 includes the base concave part 11*a*, and the base concave part 11*a* is formed along the shape of the handle part 8 of the mixing container 6. However, the embodiments of the present invention are not limited thereto, and the base concave part 11*a* may not be included, and the base concave part 11*a* may not be formed along the shape of the handle part 8 of the mixing container 6.

(11) In the configuration described as an example in the third embodiment, the convex part 13 has the inclined surface 13*c*. However, the embodiments of the present invention are not limited thereto, and the convex part 13 may not include the inclined surface 13*c*.

(12) In the configuration described as an example in the third embodiment, the convex part 13 is made up of a pair of members symmetrically formed with the groove 13*a* interposed therebetween. However, the embodiments of the present invention are not limited thereto, and the convex part 13 may not be a pair of members or may not symmetrically be formed with the groove 13*a* interposed therebetween. The convex part 13 may have the groove 13*a* allowing the movement of the partition wall 74 while supporting the container body 7.

(13) It should be understood that the embodiments disclosed in this description are illustrative in all respects, and the scope of the present invention is not limited by these embodiments. Those skilled in the art will readily understand that modifications can be made as appropriate without departing from the spirit of the present invention. Therefore, other embodiments modified without departing from the spirit of the present invention are obviously included within the scope of the present invention.

INDUSTRIAL APPLICABILITY

The present invention can be utilized for mixing multiple materials, for example.

EXPLANATIONS OF LETTERS OR NUMERALS

1 mixing container kit
2 mixing container
3 mounting member
31 receiving part
32 mounting part

33 engaging part
4 lid member (acting part)
5 container body
51 storage part
51*a* circumferential edge of storage part
52, 53 storage chamber
54 partition wall
54*a* upper edge of partition wall
55 engaged part
57 concave part
58 integrated storage chamber (one storage chamber)
59 circumferential edge of container body (circumferential edge of mixing container)
6 mixing container
7 container body
71 storage part
71*a* circumferential edge
72, 73 storage chamber
74 partition wall
74*a* upper edge of partition wall
74*b* wall surfaced portion of partition wall
74*c* first portion of partition wall
74*d* second portion of partition wall
75 engaged part
76 concave part
77 integrated storage chamber (one storage chamber)
8 handle part (acting part)
8*a* one end
8*b* the other end
81 coupling part
82 operating part
83 receiving part
83*a* circumferential edge
9 lid member
91 tab
10 assistive device
11 base
11*a* base concave part
12 hook part
12*a* through-hole
13 convex part
13*a* groove
13*b* per surface
13*c* inclined surface
D1, D2, D3 direction
X, Y material
Z mixed material

The invention claimed is:

1. A mixing container for mixing multiple materials, the mixing container comprising:

a container body including a storage part configured to store the multiple materials, the storage part having at least one partition wall formed such that a portion of an inner wall surface forming the storage part is raised toward a storage space, the at least one partition wall forming multiple storage chambers capable of separately storing the multiple materials in the storage part;

a lid member attached to the container body to seal a circumferential edge of the storage part and an upper edge of the at least one partition wall partitioning the multiple storage chambers from each other such that the multiple storage chambers are separately sealed; and a handle part having a coupling part coupled to the at least one partition wall and an operating part configured to be operated by a user, wherein:

the operating part is made up of a pair of members extending from the coupling part to respective sides opposite to each other;

the handle part includes a receiving part configured to receive at least a portion of the container body coupled to the coupling part;

the receiving part is configured such that a circumferential edge of the receiving part and the container body are flush with each other when the at least the portion of the container body is received in the receiving part;

the lid member includes a tab;

the tab is disposed along the handle part;

the mixing container is configured such that, as the operating part relatively moves in a direction from the lid member toward the container body with respect to the container body, the at least one partition wall moves together with the coupling part in the direction from the lid member toward the container body;

the at least one partition wall is configured to be deformable into a concave part recessed in a movement direction of the at least one partition wall through movement in the direction from the lid member toward the container body with the circumferential edge of the storage part sealed to the lid member; and when the at least one partition wall is deformed into the concave part, the multiple storage chambers formed by the at least one partition wall are deformed into one storage chamber.

2. The mixing container according to claim 1, wherein:

the upper edge of the at least one partition wall and the circumferential edge of the storage part are not coupled; and at least a first of the multiple storage chambers is formed in a space inside the upper edge of the at least one partition wall while at least a second of the multiple storage chambers is formed in a space between the upper edge of the at least one partition wall and the circumferential edge of the storage part.

3. The mixing container according to claim 2, wherein:

the at least one partition wall is a raised portion of the inner wall surface forming the storage part;

the at least one partition wall has at least one concave groove part formed as one of the multiple storage chambers such that a portion of the at least one partition wall is recessed in a concave shape; and the lid member seals a circumferential edge of the at least one concave groove part as the upper edge of the at least one partition wall.

4. The mixing container according to claim 3, wherein the at least one partition wall and the at least one concave groove part are concentrically formed in a central portion of the storage part.

5. The mixing container according to claim 2, wherein a capacity of the second of the multiple storage chambers is larger than a capacity of the first of the multiple storage chambers.

6. The mixing container according to claim 1, wherein, in the at least one partition wall, a wall thickness of an upper edge portion of the at least one partition wall is thicker than a wall thickness of a wall portion of the at least one partition wall outside the upper edge portion of the at least one partition wall.

7. The mixing container according to claim 1, wherein a wall thickness of a circumferential edge portion of the storage part is thicker than a wall thickness of a wall portion of the at least one partition wall on an outside of the at least one partition wall.

8. The mixing container according to claim 1, wherein:

the lid member is formed of a stretchable sheet material; and the lid member is configured such that: (i) when the lid member is pressed in a direction toward the container body, the lid member is able to press the at least one partition wall in the direction from the lid member toward the container body as the lid member is stretched; and (ii) as the lid member is pressed, the at least one partition wall moves in the direction from the lid member toward the container body.

9. The mixing container according to claim 8, wherein circumferential edges of the multiple storage chambers are sealed to the lid member by a force allowing the lid member to peel from the circumferential edges of the multiple storage chambers as the at least one partition wall is deformed into the concave part.

10. The mixing container according to claim 8, wherein the lid member is stretchable due to plastic deformation.

11. The mixing container according to claim 8, wherein a maximum stretch amount due to plastic deformation of the lid member is an amount allowing positions of portions sealing circumferential edges of the multiple storage chambers after the plastic deformation to be located above positions of portions corresponding to the circumferential edges of the multiple storage chambers after the at least one partition wall is deformed into the concave part.

12. A mixing container kit for mixing multiple materials, the mixing container kit comprising:

the mixing container according to claim 8; and a mounting member having a hollow receiving part configured to receive the storage part and a mounting part on which the circumferential edge of the storage part is mounted.

13. The mixing container kit according to claim 12, further comprising a retaining mechanism configured to retain the concave part at a position when the at least one partition wall is deformed into the concave part.

14. The mixing container kit according to claim 13, wherein, for the retaining mechanism, an engaged part is formed outside a storage space of a portion serving as the concave part when the at least one partition wall is deformed into the concave part in the storage part, while an engaging part is formed under the hollow receiving part in the mounting member and is engageable with the engaged part when the at least one partition wall is deformed into the concave part.

15. The mixing container according to claim 1, wherein:

the coupling part includes a concealed portion that is not exposed outside when the at least one partition wall is not deformed into the concave part and that is exposed outside when the at least one partition wall is deformed into the concave part; and the concealed portion has an appearance which is distinguishable from another portion of the coupling part.

16. An assistive device of the mixing container according to claim 1, the assistive device comprising:

a base;

a hook part disposed on the base and engaged with a first end of the handle part; and a convex part disposed on the base and supporting a portion of the container body at a position separated from the hook part in a thickness direction of the base, wherein:

the convex part is defined with a groove configured to allow movement of the at least one partition wall;

the convex part is capable of retaining a second end of the handle part away from the base by supporting the portion of the container body with the first end of the handle part; and the at least one partition wall is configured such that, by moving the second end of the handle part in a direction toward the base with the portion of the container body supported by the convex part, the at least one partition wall is relatively moved in the groove in the direction from the lid member toward the container body with respect to the portion of the container body.

* * * * *